US008845441B2

(12) United States Patent
Trapp et al.

(10) Patent No.: US 8,845,441 B2
(45) Date of Patent: Sep. 30, 2014

(54) RECONFIGURABLE INFANT SUPPORT STRUCTURE

(75) Inventors: Timothy J. Trapp, Orchard Park, NY (US); John DeRubes, Grand Island, NY (US); Domenic T. Gubitosi, East Aurora, NY (US); Brian S. Kelly, East Aurora, NY (US); John Martin Maul, Machias, NY (US); Philip R. Pyrce, Amherst, NY (US); Robert W. Salmon, Buffalo, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 13/587,053

(22) Filed: Aug. 16, 2012

(65) Prior Publication Data

US 2013/0123031 A1 May 16, 2013

Related U.S. Application Data

(63) Continuation of application No. 12/729,423, filed on Mar. 23, 2010, now Pat. No. 8,267,803, which is a continuation-in-part of application No. 11/403,192, filed on Apr. 13, 2006, now Pat. No. 7,727,076, which is a continuation-in-part of application No. 11/209,036, filed on Aug. 23, 2005, now Pat. No. 7,438,644, which is a continuation of application No. 10/772,338, filed on Feb. 6, 2004, now Pat. No. 6,932,709.

(51) Int. Cl.

| | |
|---|---|
| ***A63G 13/04*** | (2006.01) |
| ***A47D 13/10*** | (2006.01) |
| *A63G 23/00* | (2006.01) |

(52) U.S. Cl.

CPC ..... *A47D 13/107* (2013.01)
USPC ..... 472/135; 446/227

(58) Field of Classification Search

CPC ..... A47D 13/105; A47D 13/107; A47D 9/00; A47D 9/02; A47D 13/10; A63G 9/00; A63G 9/12; A63G 13/00; A63G 13/08
USPC ..... 472/103–105, 118, 125, 135; 446/227; 297/273, 274

See application file for complete search history.

(56) References Cited

U.S. PATENT DOCUMENTS

| | | | |
|---|---|---|---|
| 131,349 | A | 9/1872 | Holmes |
| 616,697 | A | 12/1898 | Cowles et al. |
| 707,774 | A | 8/1902 | Blackledge |
| 775,133 | A | 11/1904 | Gaines |

(Continued)

FOREIGN PATENT DOCUMENTS

| | | |
|---|---|---|
| CA | 497983 | 12/1953 |
| DE | 3304443 | 8/1984 |
| WO | 2005117663 | 12/2005 |

*Primary Examiner* — Kien Nguyen
(74) *Attorney, Agent, or Firm* — Edell, Shapiro & Finnan, LLC

(57) ABSTRACT

An infant support structure includes a support frame having a lower member configured to engage a support surface. First and second spaced arcuate posts extend upwardly from the lower member, each of the posts having a distal end portion. A seat portion is disposed between and coupled to the posts. A first end of a toy bar is secured to the distal end portion of one of the posts, and a second end of the toy bar is secured to the distal end portion of the other of the posts.

22 Claims, 28 Drawing Sheets

(56) References Cited

U.S. PATENT DOCUMENTS

| | | | |
|---|---|---|---|
| 1,256,548 | A | 2/1918 | Gannon |
| 1,326,921 | A | 1/1920 | Dzimitowicz |
| 1,428,039 | A | 9/1922 | Kratz |
| 1,806,454 | A | 5/1931 | Goudeau |
| 1,931,567 | A | 10/1933 | Arends |
| 1,950,042 | A | 3/1934 | Upper |
| 2,006,492 | A | 7/1935 | Van Santen |
| 2,282,086 | A | 5/1942 | Peltier |
| D137,437 | S | 3/1944 | Driscoll |
| 2,347,754 | A | 5/1944 | Shay |
| 2,521,422 | A | 9/1950 | Strand, Jr. et al. |
| 2,645,271 | A | 7/1953 | Call et al. |
| 2,700,413 | A | 1/1955 | Williams |
| 2,715,935 | A | 8/1955 | Berry, Jr. |
| 2,855,023 | A | 10/1958 | Mekeel et al. |
| 3,029,551 | A | 4/1962 | Reiskin |
| 3,462,113 | A | 8/1969 | Macleod |
| 3,747,596 | A | 7/1973 | Mills |
| 3,765,674 | A | 10/1973 | Siler |
| 3,796,430 | A | 3/1974 | Sudo |
| 3,992,023 | A | 11/1976 | Moorer |
| 4,025,083 | A | 5/1977 | Saint |
| 4,045,045 | A | 8/1977 | Boucher et al. |
| 4,084,812 | A | 4/1978 | Melrose et al. |
| 4,094,547 | A | 6/1978 | Zampino et al. |
| 4,123,078 | A | 10/1978 | Murakami |
| 4,140,311 | A | 2/1979 | Murakami |
| 4,141,095 | A | 2/1979 | Adachi |
| 4,171,132 | A | 10/1979 | Kassai |
| 4,171,847 | A | 10/1979 | Tukui |
| 4,205,670 | A | 6/1980 | Owens |
| 4,225,146 | A | 9/1980 | Takeuchi |
| 4,231,582 | A | 11/1980 | Moss |
| 4,298,228 | A | 11/1981 | Zampino et al. |
| 4,359,045 | A | 11/1982 | Cozzi |
| 4,359,242 | A | 11/1982 | Gerken et al. |
| 4,364,576 | A | 12/1982 | Kassai |
| 4,553,786 | A | 11/1985 | Lockett, III et al. |
| 4,576,392 | A | 3/1986 | Quinlan, Jr. |
| 4,615,523 | A | 10/1986 | Chen |
| 4,699,392 | A | 10/1987 | Ku |
| 4,822,030 | A | 4/1989 | Cone |
| 4,836,534 | A | 6/1989 | Lewis |
| 4,948,120 | A | 8/1990 | Krueger et al. |
| 5,052,749 | A | 10/1991 | Groenendijk |
| 5,054,851 | A | 10/1991 | Chiu |
| 5,082,325 | A | 1/1992 | Sedlack |
| D327,777 | S | 7/1992 | Tepper |
| 5,156,176 | A | 10/1992 | Doorenbos |
| 5,172,955 | A | 12/1992 | Freese et al. |
| 5,201,693 | A | 4/1993 | Sparkes |
| 5,207,478 | A | 5/1993 | Freese et al. |
| 5,328,410 | A | 7/1994 | Amburgey et al. |
| 5,407,246 | A | 4/1995 | Meeker et al. |
| 5,445,585 | A | 8/1995 | Meeker |
| 5,451,093 | A | 9/1995 | Petrie et al. |
| 5,490,711 | A | 2/1996 | Pollock |
| 5,499,949 | A | 3/1996 | Heubl |
| 5,509,721 | A | 4/1996 | Huang |
| D376,052 | S | 12/1996 | Cone et al. |
| D378,554 | S | 3/1997 | Meeker et al. |
| 5,615,428 | A | 4/1997 | Li |
| 5,624,321 | A | 4/1997 | Snyder |
| 5,642,750 | A | 7/1997 | Brown et al. |
| 5,645,489 | A | 7/1997 | Laiche et al. |
| 5,688,211 | A | 11/1997 | Myers |
| 5,690,383 | A | 11/1997 | Meeker |
| 5,700,201 | A | 12/1997 | Bellows et al. |
| 5,704,576 | A | 1/1998 | Meeker et al. |
| 5,704,882 | A | 1/1998 | Coates et al. |
| 5,728,030 | A | 3/1998 | Hsieh et al. |
| D395,467 | S | 6/1998 | Bellows |
| 5,816,983 | A | 10/1998 | Dawes et al. |
| 5,857,944 | A | 1/1999 | Cone et al. |
| 5,868,459 | A | 2/1999 | Welsh, Jr. |
| 5,876,311 | A | 3/1999 | Coates et al. |
| 5,930,854 | A | 8/1999 | O'Neill et al. |
| 5,934,747 | A | 8/1999 | Garland |
| 5,947,875 | A | 9/1999 | Cone et al. |
| 5,975,628 | A | 11/1999 | Russell |
| 6,030,039 | A | 2/2000 | Essler |
| 6,036,604 | A | 3/2000 | Klitsner |
| 6,048,290 | A | 4/2000 | Chen et al. |
| 6,170,840 | B1 | 1/2001 | Mathias |
| 6,179,376 | B1 | 1/2001 | Meeker et al. |
| 6,244,606 | B1 | 6/2001 | Yang |
| 6,299,247 | B1 | 10/2001 | Meeker et al. |
| 6,319,138 | B1 | 11/2001 | Fair et al. |
| 6,383,085 | B1 | 5/2002 | Tseng |
| 6,520,862 | B1 | 2/2003 | Armbruster et al. |
| 6,540,579 | B1 | 4/2003 | Gubitosi et al. |
| 6,592,425 | B2 | 7/2003 | Bapst et al. |
| 6,648,411 | B2 | 11/2003 | Julien |
| 6,932,709 | B1 | 8/2005 | Gubitosi et al. |
| 6,994,630 | B2 | 2/2006 | Paesang |
| 7,614,979 | B2 * | 11/2009 | Thomson et al. ..... 482/69 |
| 2002/0002741 | A1 | 1/2002 | Tomas et al. |
| 2002/0027382 | A1 | 3/2002 | Bellows et al. |
| 2002/0043824 | A1 | 4/2002 | Bellows et al. |
| 2002/0043825 | A1 | 4/2002 | Bellows et al. |
| 2002/0115535 | A1 | 8/2002 | Stern et al. |
| 2002/0164917 | A1 | 11/2002 | Keegan et al. |
| 2003/0020317 | A1 | 1/2003 | Keegan et al. |
| 2003/0222421 | A1 | 12/2003 | Myers et al. |
| 2004/0119258 | A1 | 6/2004 | Yoo |

* cited by examiner

RECONFIGURABLE INFANT SUPPORT STRUCTURE

CROSS REFERENCE TO RELATED APPLICATIONS AND CLAIM TO PRIORITY

This application is a continuation of U.S. patent application Ser. No. 12/729,423, filed Mar. 23, 2010, now U.S. Pat. No. 8,267,803, which is a continuation-in-part of U.S. patent application Ser. No. 11/403,192, filed Apr. 13, 2006, now U.S. Pat. No. 7,727,076, which is a continuation-in-part of U.S. patent application Ser. No. 11/209,036, filed on Aug. 23, 2005, now U.S. Patent No. 7,438,644, which is a continuation of U.S. patent application Ser. No. 10/772,338, filed Feb. 6, 2004, now U.S. Pat. No. 6,932,709, the disclosures of which are all incorporated herein by reference in their entireties.

FIELD OF THE INVENTION

The invention relates generally to an infant support structure, and in particular, a free-standing jumper including a toy bar coupled to and extending between posts of the support frame.

BACKGROUND OF THE INVENTION

Swings, jumpers, bouncers and other similar devices are typically used to keep a child entertained and stimulated in a safe location. Additionally, such devices also provide an environment that promotes the development of a child's gross motor skills. Known jumpers, however, are often inconvenient to use, difficult to store, and not adjustable to accommodate children of different sizes.

For example, some known jumpers can be suspended from an available structure, such as a doorframe. Such known jumpers, however, can impede movement of others through the doorway. Additionally, suitable doorframes are not always available or convenient. Moreover, such devices may not provide the level of security desired by some caretakers. Other known jumpers include a support frame from which a seat is suspended. Such known jumpers can be difficult to adjust to accommodate children of different sizes.

Thus, there is a need for a device that can be easily stored and moved. Also, a need exists for a jumper that is free-standing with a stable base and that is easily adjustable.

SUMMARY OF THE INVENTION

Children's jumping apparatuses are described herein. In one embodiment an apparatus includes a support frame, a resilient member, a seat, and a retainer. The resilient member has a first end portion configured to be coupled to the support frame and a second end portion, opposite from the first end portion. The seat is configured to be coupled to the second end portion such that the seat is suspended from the support frame by the resilient member. At least one of the first end portion and the second end portion includes multiple sleeves, each defining an opening therein. A portion of the retainer is configured to be disposed within a first one of the sleeves and to be coupled to at least one of the seat and the support frame such that a position of the seat relative to the support frame is adjustable by disposing the portion of the retainer within a second one of the sleeves, the second sleeve being different from the first sleeve.

The present invention is also directed to an infant support structure including a support frame having a lower portion configured to engage a support surface, a first post extending upwardly from the lower portion and having a distal end portion, and a second post extending upwardly from the lower portion and having a distal end portion. A seat portion is disposed between the first post and the second post. The seat portion is coupled to and movably supported from at least one of the first post and the second post. A toy bar includes a first end releasably coupleable to the distal end portion of the first post and an opposite second end releasably coupleable to the distal end portion of the second post.

In one embodiment, the distal ends of the first and second posts are located in a first plane. The seat portion is located beneath the first plane, and the toy bar extends above the first plane.

In one embodiment, each of the distal end portions includes a receiving portion. The first end of the toy bar includes a mounting mechanism that is releasably coupleable to the receiving portion of one of the distal end portions.

In one embodiment, the support frame includes a third post extending upwardly from the lower portion. The first, second and third posts are circumferentially spaced around the seat portion. The seat is coupled to and movably supported from the first, second and/or third posts. In one implementation, the seat portion is coupled to the first, second and/or third posts via resilient members.

In one embodiment, the lower portion of the support frame has a sinusoidal configuration. In other embodiments, the lower portion of the support frame has a substantially circular configuration. In some embodiments, each of the first, second and/or third posts has an arcuate configuration bowing outwardly from a perimeter of the lower portion.

The present invention also relates to an infant support structure including a support frame having a lower portion configured to engage a support surface, a plurality of posts extending upwardly from the lower portion, a seat portion configured to receive an infant, and a toy bar. Each of the posts has a distal end portion. A resilient member extends between and is coupled to each post and to the seat portion, so that the seat portion is movably suspended from the support frame. A first end of the toy bar is releasably securable to a distal end portion of one post and an opposite second end of the toy bar is releasably securable to a distal end portion of another post.

In one embodiment, first post has an opening formed in its distal end. The opening is configured to receive the first end of the toy bar. A second post has an opening formed in its distal end. The opening of the second post is configured to receive the second end of the toy bar.

In one embodiment, the plurality of posts includes first, second and third arcuate posts bowing outwardly from a perimeter of the lower portion. In one implementation, the first, second and third arcuate posts are substantially uniformly spaced about the perimeter of the lower portion.

In one embodiment, the lower portion of the support frame is comprised of a plurality of sections coupled together. In one implementation, at least one of the sections has a sinusoidal configuration. In another implementation, adjacent sections of the plurality of sections are coupled together via a connector. Each one of the plurality of posts is coupled to and extends upwardly from a corresponding connector.

The present invention also relates to an infant support structure including a support frame including a lower member configured to engage a support surface, a first arcuate post extending upwardly from the lower member and having a distal end portion, and a second arcuate post extending upwardly from the lower member and having a distal end portion. The first and second arcuate posts bow outwardly from a perimeter of the lower member. A seat portion is disposed between and coupled to the first and second posts. A toy bar includes a first end secured to the distal end portion of the first arcuate post, and a second end secured to the distal end portion of the second arcuate post.

In one embodiment, the first end of the toy bar is releasably secured to the distal end portion of the first arcuate post. The second end of the toy bar is releasably secured to the distal end portion of the second arcuate post.

BRIEF DESCRIPTION OF THE DRAWINGS

FIG. 4A is a plan view of the child support portion of the jumping device illustrated in

FIG. 3.

Like reference numerals have been used to identify like elements throughout this disclosure.

DETAILED DESCRIPTION OF THE INVENTION

Figure 1A:
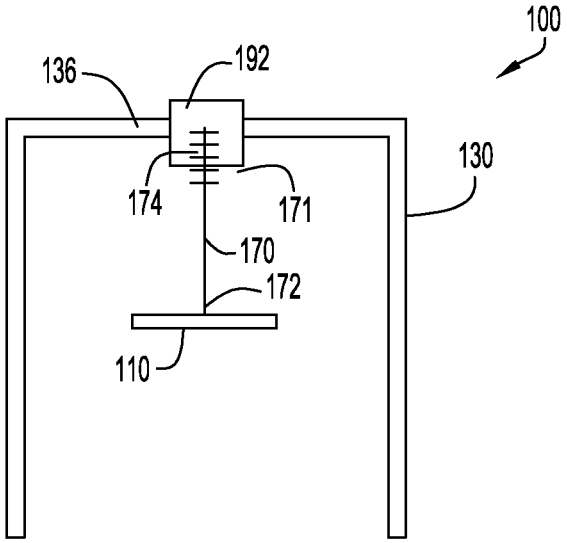
FIGS. 1A and 1B are schematic illustrations of a jumping device according to an embodiment of the invention in a first position and a second position, respectively.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

The terms "infant support structure" and "support structure" may be used interchangeably herein, and refer to a structure that can be used to support and/or retain a child or infant, such as for example a jumper and an infant seat.

Children's jumping apparatuses are described herein. In one embodiment an apparatus includes a support frame, a resilient member, a seat, and a retainer. The resilient member has a first end portion configured to be coupled to the support frame and a second end portion, opposite from the first end portion. The seat is configured to be coupled to the second end portion such that the seat is suspended from the support frame by the resilient member. At least one of the first end portion and the second end portion includes a set of sleeves, each defining an opening therein. A portion of the retainer is configured to be disposed within a first sleeve from the set of sleeves and to be coupled to at least one of the seat and the support frame. In this manner, a position of the seat relative to the support frame is adjustable by disposing the portion of the retainer within a second sleeve from the set of sleeves, the second sleeve being different from the first sleeve.

In some embodiments, the second end portion of the resilient member includes a set of sleeves and the seat includes an attachment portion having a top surface and a bottom surface. The attachment portion of the seat defines an opening between the top surface and the bottom surface. The second end portion of the resilient member is configured to be disposed within the opening such that at least one sleeve is disposed below the bottom surface. The retainer is configured to be removably coupled to the bottom surface of the attachment portion. In this manner, the position of the seat relative to the support frame is adjustable by disposing a portion of the retainer within the desired sleeve.

In some embodiments, the first end portion of the resilient member includes a set of sleeves and the support frame includes an attachment member having a first surface and a second surface. The attachment member defines an opening between the first surface and the second surface. The first end portion of the resilient member is configured to be disposed within the opening such that at least one sleeve is disposed adjacent the first surface. The retainer is configured to be removably coupled to the first surface of the attachment member. In this manner, the position of the seat relative to the support frame is adjustable by disposing a portion of the retainer within the desired sleeve.

In yet other embodiments, an apparatus includes a support frame, a resilient member, a seat and a retainer. The resilient member has a first end portion, a second end portion and a central portion located between the first end portion and the second end portion. At least one of the first end portion and the second end portion includes a set of sleeves, each defining an opening therein. The central portion of the resilient member is configured to cooperate with the support frame. For example, in some embodiments, a portion of the central portion of the resilient member is configured to be disposed within a portion of the support frame. The seat is configured to be coupled to the first end portion of the resilient member and the second end portion of the resilient member such that the seat is suspended from the support frame by the resilient member. A portion of the retainer is configured to be disposed within a first sleeve from the set of sleeves and to be coupled to the seat. In this manner, a position of the seat relative to the support frame is adjustable by disposing the portion of the retainer within a second sleeve from the set of sleeves.

In yet other embodiments, an apparatus includes a seat, a support frame, a resilient member and a retainer. The resilient member has a first end portion, a second end portion and a central portion located between the first end portion and the second end portion. At least one of the first end portion and the second end portion includes a set of sleeves, each defining an opening therein. The first end portion and the second end portion are configured to be coupled to the support frame while the central portion is configured to be coupled to the seat such that the seat is suspended from the support frame by the resilient member. A portion of the retainer is configured to be disposed within a first sleeve from the plurality of sleeves and coupled to the support frame such that a position of the seat relative to the support frame is adjustable by disposing the portion of the retainer within a second sleeve from the plurality of sleeves.

In yet other embodiments, an apparatus includes a support frame, a first resilient member, a second resilient member, a child support member and a seat. The support frame has a first and a second A-shaped frame portion, each having a first leg, a second leg and an apex. The second A-shaped frame portion is spaced laterally from the first A-shaped frame portion. The support frame has a ground-engaging portion configured to be coupled to each of the first and the second A-shaped frame portions. The first resilient member has a first end portion coupled to at least one of the first leg and the second leg of the first frame portion substantially spaced beneath the apex of the first frame portion and a second end portion opposite from the first end portion. The second resilient member has a first end portion coupled to at least one of the first leg and the second leg of the second frame portion substantially spaced beneath the apex of the second frame portion and a second end portion opposite from the first end portion. The child support member is configured to be coupled to the second end portion of the first resilient member and the second end portion of the second resilient member such that the child support member is suspended from the first frame portion and the second frame portion by the resilient members. The seat is rotatably coupled to the child support member.

Figure 1B:
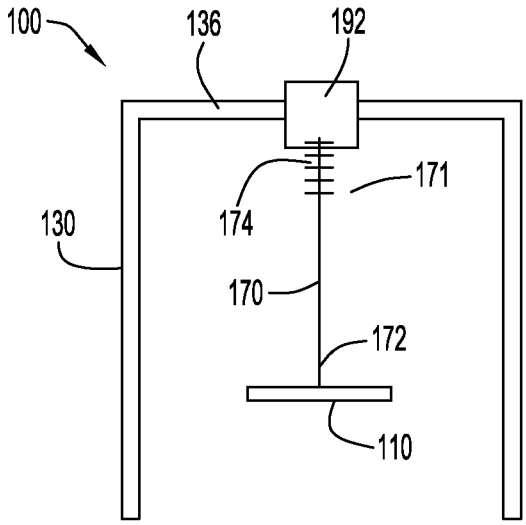

FIGS. 1A and 1B are schematic illustrations of a jumping device 100 according to an embodiment of the invention in a first position and a second position, respectively. The illustrated jumping device 100 includes a support frame 130, a resilient member 170, a child support member 110 and a retainer 192. The resilient member 170 has a first end portion 171 and a second end portion 172 coupled to the child support member 110. The first end portion 171 of the resilient member 170 includes a set of sleeves 174. The retainer 192, a portion of which is disposed within a sleeve from the set of sleeves 174, is coupled to an overhead member 136 of the support frame 130. In this manner, the first end portion 171 of the resilient member 170 is coupled to the support frame 130 such that the child support member 110 is suspended from the support frame 130. The position of the child support member 110 relative to the support frame 130 can be selectively adjusted by disposing the portion of the retainer 192 within a different sleeve from the set of sleeves 174. For example, depending on the sleeve in which the retainer 192 is disposed, the length of the resilient member 170 can be effectively shortened, thereby raising the position of the child support member 110, as shown in FIG. 1A. Conversely, by selecting a different sleeve from the set of sleeves 174, the length of the resilient member 170 can be effectively lengthened, thereby lowering the position of the child support member 110, as shown in FIG. 1B. In this manner, the jumping device 100 can be reconfigured to accommodate children of varying ages and sizes.

Figure 2A:
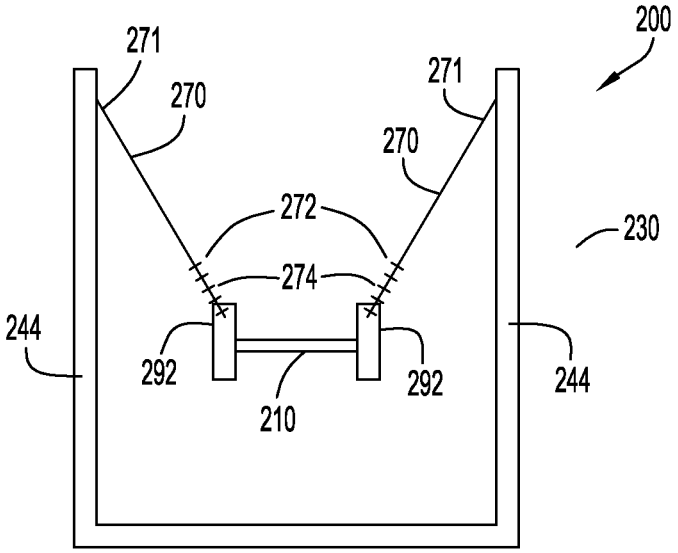
FIGS. 2A and 2B are schematic illustrations of a jumping device according to an embodiment of the invention in a first position and a second position, respectively.
Figure 2B:
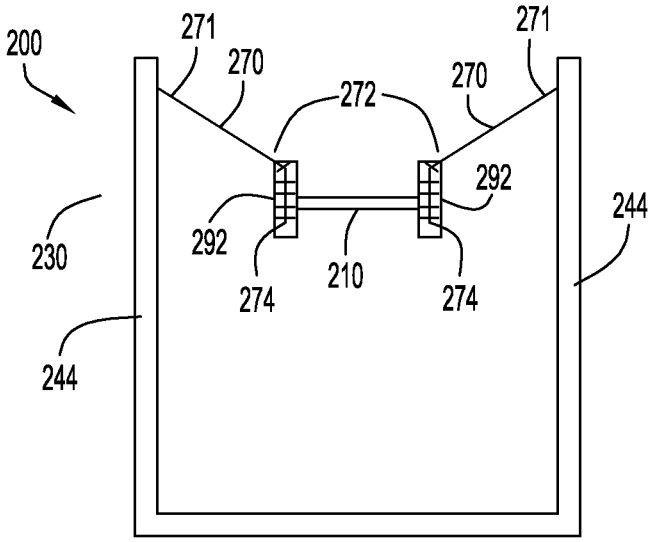

FIGS. 2A and 2B are schematic illustrations of a jumping device 200 according to an embodiment of the invention in a first position and a second position, respectively. The illustrated jumping device 200 includes a support frame 230, two resilient members 270, a child support member 210 and two retainers 292. Each of the resilient members 270 has a first end portion 271 and a second end portion 272. The first end portion 271 of each resilient member 270 is coupled to an upright portion 244 of the support frame 230. The second end portion 272 of each resilient member 270 includes a set of sleeves 274. A portion of each of the retainers 292 is disposed within a sleeve from the set of sleeves 274 and is coupled to the child support member 210. In this manner, the second end portion 272 of each resilient member 270 is coupled to the child support member 210 such that the child support member 210 is suspended from the upright portions 244 of the support frame 230. The position of the child support member 210 relative to the support frame 230 is selectively adjustable by disposing the portion of each retainer 292 within a different sleeve from the set of sleeves 274 in each resilient member 270, as described above. For example, the length of the resilient members 270 can be effectively shortened, thereby raising the position of the child support member 210, as shown in FIG. 2B. Conversely, the length of the resilient members 270 can be effectively lengthened, thereby lowering the position of the child support member 210, as shown in FIG. 2A.

Figure 8:
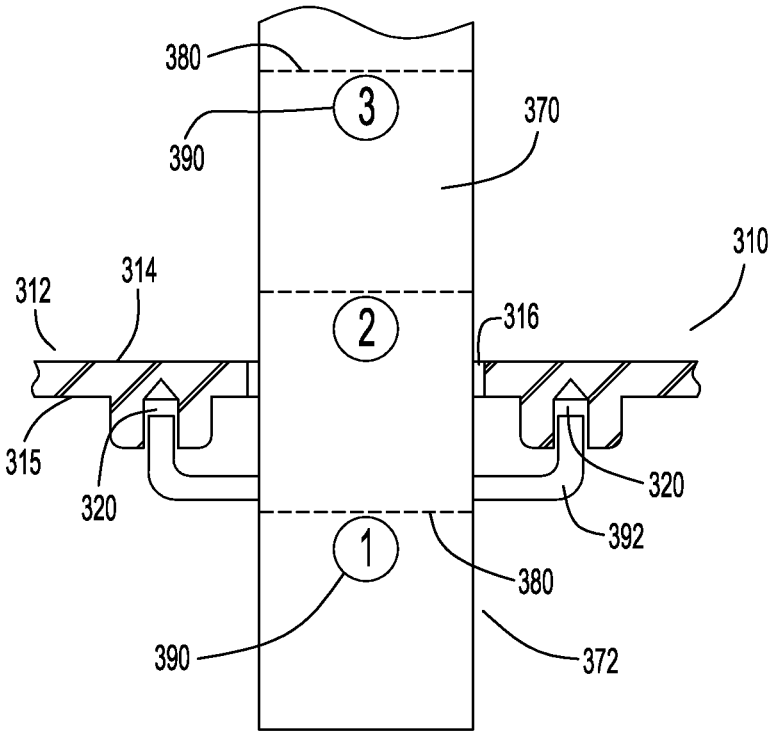
FIG. 8 is a cross-sectional view taken along section A-A of the jumping device illustrated in FIG. 4A.

FIGS. 3-6 and 8 illustrate a jumping device 300 according to an embodiment of the invention that includes a support frame 330, three resilient members 370, a child support member 310 and at least one retainer 392 (see FIG. 8). Each of the resilient members 370 has a first end portion 371 and a second end portion 372. The first end portion 371 of each resilient member 370 is coupled to the support frame 330. The second end portion 372 of each resilient member 370 includes a set of sleeves 374 (see FIGS. 5 and 6). A portion of each retainer 392 is disposable within a sleeve from the set of sleeves 374 (see FIG. 8). Each retainer is coupled to the child support member 310, thereby coupling the second end portion 372 of each resilient member 370 to the child support member 310 such that the child support member 310 is suspended from the support frame 330. As discussed herein, the position of the child support member 310 relative to the support frame 330 is selectively adjustable by disposing the portion of each retainer 392 within a different sleeve from the set of sleeves 374 in each resilient member 370.

Figure 3:
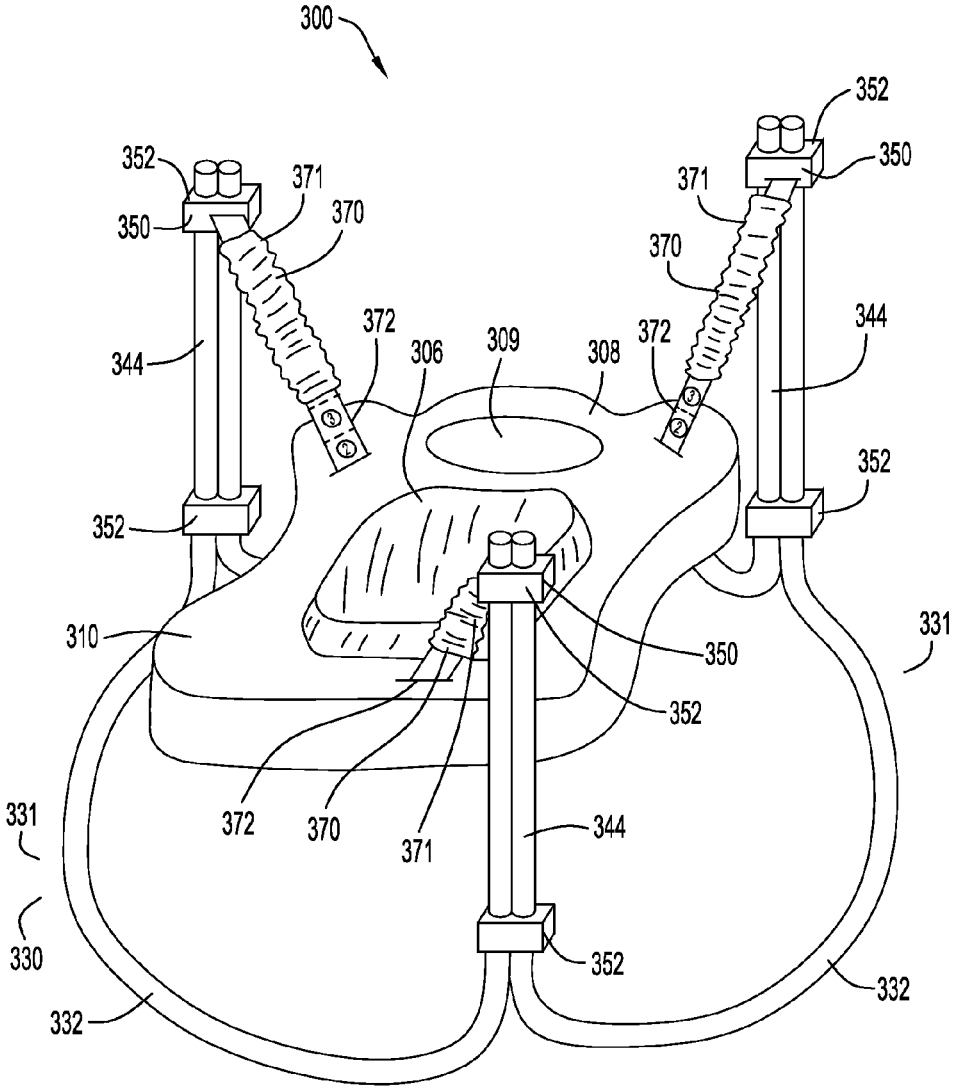
FIG. 3 is a perspective view of a jumping device according to an embodiment of the invention.

As illustrated in FIG. 3, the support frame 330 includes three upright members 331 removably coupled together by a series of connectors 352. Each of the upright members 331 includes a base portion 332 and two upright portions 344. The upright members 331 can be constructed of aluminum, steel, plastic or any other suitable material. The connectors 352 can be, for example, plastic clips configured to be removably coupled to a portion of the upright portion 344 of adjacent upright members 331. In some embodiments, the connectors 352 are configured to be fixedly coupled to the upright portion 344 of one upright member 331 while removably coupled to the upright portion 344 of the adjacent upright member 331 via an interference fit. In this manner, when the jumping device 300 is disassembled, the connectors 352 remain connected to one upright member 331, thereby preventing them from being misplaced.

In the illustrated embodiment, each of the resilient members 370 has a first end portion 371 and a second end portion 372. The first end portion 371 of each resilient member 370 is coupled to the upright portion 344 of an upright member 331 by an attachment member 350. In the illustrated embodiment, the attachment members 350 can also act as connectors 352 to couple the upright portions 344 of adjacent upright members 331. In other embodiments, the attachment members 350 are distinct from the connectors 352. In yet other embodiments, the attachment members 350 are not separate components, but rather, are integral to the upright portions 344 of the upright members 331. In some embodiments the first end portion 371 is fixedly attached to the attachment member 350. For example, the first end portion 371 can be molded into a portion of the attachment member 350. In other embodiments, the first end portion 371 is removably attached to the attachment member 350. For example, the first end portion 371 of the resilient member 370 can be coupled to the attachment member 350 by a fastener, an elastic strap, or by a sleeve-and-retainer combination.

Figure 4A:
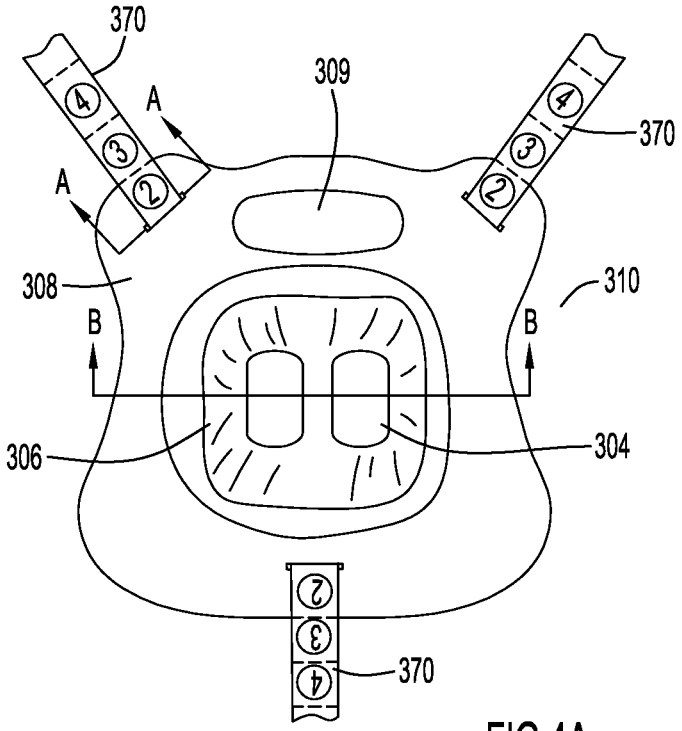
Figure 4B:
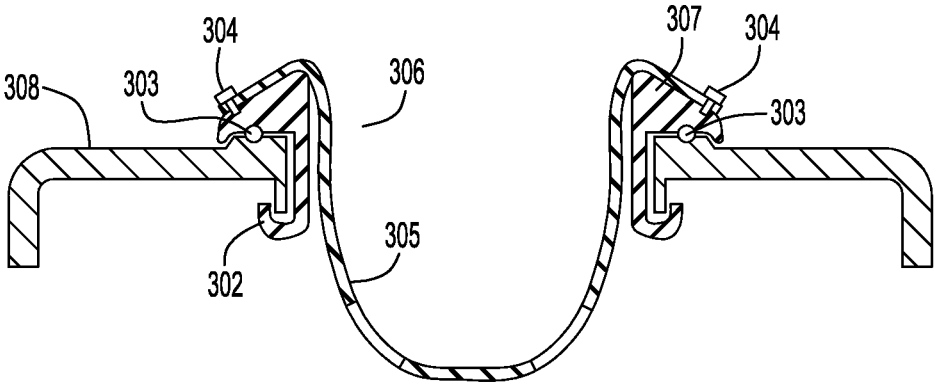
FIG. 4B is a cross-sectional view taken along section B-B of the jumping device illustrated in FIG. 4A.

The child support member 310 includes a tray portion 308 and a seat 306. The second end portion 372 of each resilient member 370 is coupled to the child support member 310 such that the child support member 310 is suspended from the support frame 330. As illustrated in FIGS. 4A and 4B, the seat 306 is coupled to and supported by the tray portion 308. The seat 306 includes a padded material 305 suitable for comfortable seating of a child and a seat frame 307 that supports the padded material 305. The padded material 305 is removably coupled to the seat frame 307 by a series of fasteners 304, such as snaps or buttons. In this manner the padded material 305 can be easily removed for cleaning.

In some embodiments, the seat 306 is rotatably coupled to the tray portion 308 to allow a child to freely spin while positioned in the seat 306. In the illustrated embodiment, the rotational coupling is accomplished, for example, by disposing a set of ball bearings 303 between the seat frame 307 and the tray portion 308, as illustrated in FIG. 4B. The seat frame 307 includes a retaining portion 302 to prevent the seat frame 307 from being inadvertently removed from the tray portion 308. Other suitable mechanisms for rotatably coupling the seat 306 to the tray portion 308 are described, for example, in U.S. patent application Ser. No. 10/235,837, entitled "Entertainment Toy Having Multiple Configurations," filed Sep. 6, 2002, which is incorporated herein by reference in its entirety.

The tray portion 308 includes a recessed area 309 configured to retain food, drinks and/or toys for entertaining a child. In some embodiments, the tray portion 308 includes an attachment member (not shown in FIGS. 4A and 4B) configured to receive toys. Such an attachment member can include, for example, a rod from which toys can be suspended and/or a mounting member to which a base portion of a toy can be mounted.

Figure 5:
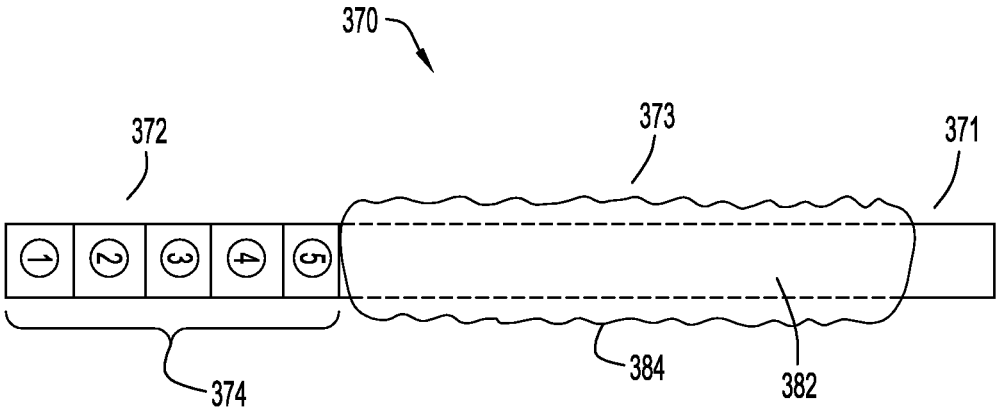
FIG. 5 is a plan view of a resilient member of the jumping device shown in FIG. 3.

FIG. 5 is a plan view of a resilient member 370 of the jumping device 300 shown in FIG. 3. The resilient member 370 includes a first end portion 371, a second end portion 372 and a central portion 373. The first end portion 371 and the second end portion 372 are flexible and substantially inelastic. As discussed above, the first end portion 371 is coupled to the upright portion 344 of an upright member 331 by an attachment member 350. In some embodiments, the resilient member 370 is monolithically formed such that the first end portion 371 and the second end portion 372 are flexible and substantially inelastic while the central portion 373 includes an elastic portion 382. Suitable materials for the end portions 371, 372 of the resilient member include plastic, nylon, polyester, leather, and the like. Suitable materials for the elastic portion 382 include any suitable elastomer, such as rubber.

A cover 384 is disposed about a portion of the resilient member 370 to provide a more comfortable surface for the child to grasp the resilient member 370. The cover 384 is fabricated from a material sufficiently thick to protect the child against uncomfortable edges that may be present on the resilient member 370, but pliable enough to expand and contract with the elastic portion 382 of the resilient member 370 during movement of child support member 310. Suitable materials for cover 384 include soft plastic, leather, nylon, and the like.

Figure 7:
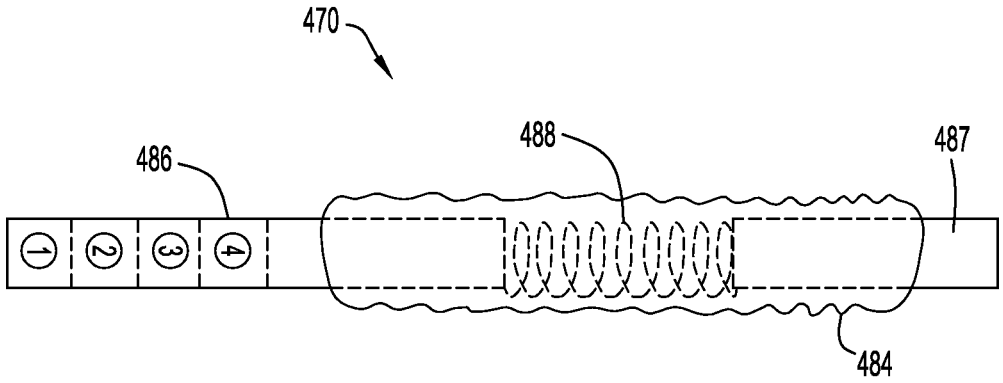
FIG. 7 is a plan view of a resilient member of a jumping device according to an embodiment of the invention.

In other embodiments, the resilient member includes separate components joined to form the resilient member. For example, as illustrated in FIG. 7, in some embodiments, a resilient member 470 includes a first strap 487, a second strap 486 and a spring 488 coupled to and disposed between the first strap 487 and the second strap 486. A cover 484 is disposed about a portion of the resilient member 470 to prevent pinch points in the spring 488 from being exposed to the child as the spring expands and contracts when the child support member moves. As described above, the cover 484 is fabricated from a material sufficiently thick to protect the child against pinching, but pliable enough to expand and contract with the spring 488 during movement of child support member.

Figure 6:
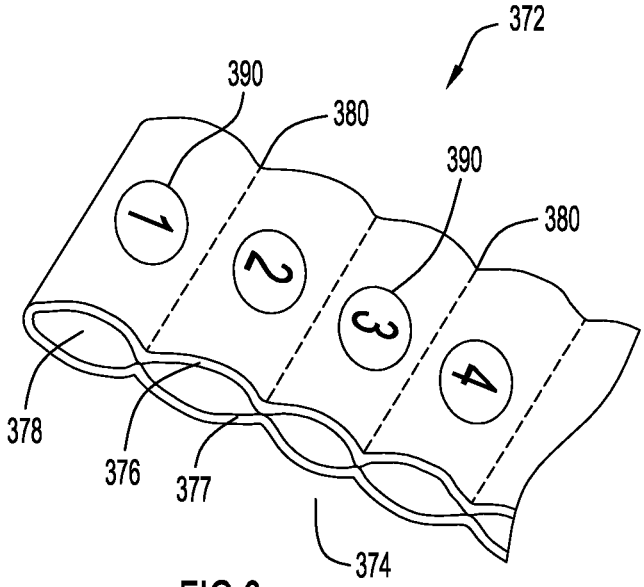
FIG. 6 is a perspective view of an end portion of a resilient member of the jumping device illustrated in FIG. 3.

As illustrated in FIGS. 5 and 6, the second end portion 372 of the resilient member 370 includes a set of sleeves 374. The set of sleeves 374 is formed by coupling a first sleeve portion 376 and a second sleeve portion 377 at predefined locations 380 to form a set of openings 378. The first sleeve portion 376 and second sleeve portion 377 can be coupled, for example, by stitching, adhesive or any other suitable means. In other embodiments, the resilient member is monolithically formed, such as by an extrusion process, to include the set of sleeves.

Each sleeve from the set of sleeves 374 includes visual indicia 390, such as a reference numeral, that indicates the relative position in which the second end portion 372 is coupled to the child support member 310. In other embodiments, the visual indicia can be color, a figure or any other suitable indicia for indicating the relative position of the second end portion of the resilient member. In some embodiments, the visual indicia are associated with the height and/or weight of the child to be placed in the jumping device.

The second end portion 372 of each resilient member 370 is coupled to the child support member 310 such that the child support member 310 is suspended from the support frame 330. More specifically, as illustrated in FIG. 8, the child support member 310 includes an attachment portion 312 having a top surface 314 and a bottom surface 315. The attachment portion 312 defines an opening 316 between the top surface 314 and the bottom surface 315 that receives the second end portion 372 of the resilient member 370. A portion of the retainer 392 is disposed within the opening 378 of a sleeve from the set of sleeves 374 and the retainer 392 is coupled to the bottom surface 315 of the attachment portion 312 of the child support member 310. In some embodiments, the bottom surface 315 of the attachment portion 312 defines a set of holes 320 configured to receive a portion of the retainer 392. The holes 320 are sized to provide an interference fit with the mating portion of the retainer 392, thereby ensuring that the retainer 392 remains coupled to the bottom surface 315 when the jumping device 300 is in use. In this manner, the position of the child support member 310 relative to the support frame 330 can be selectively adjusted by disposing a portion of the retainer within the desired sleeve from the set of sleeves 374.

Figure 9A:
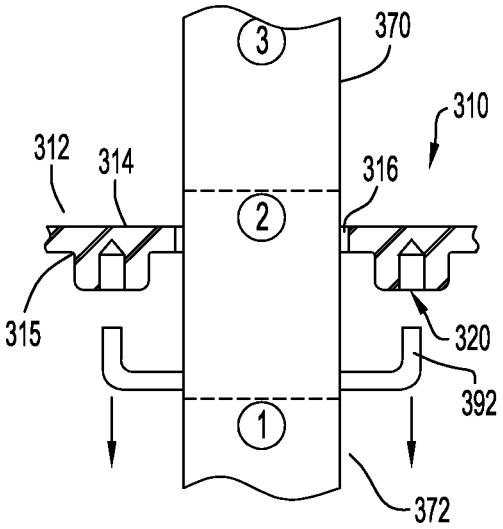
FIGS. 9A-9D are cross-sectional views taken along section A-A of the jumping device illustrated in FIG. 4A showing the operation of the adjustment mechanism.
Figure 9B:
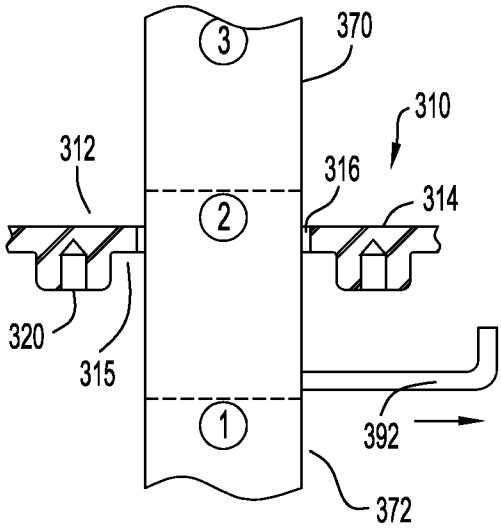
Figure 9C:
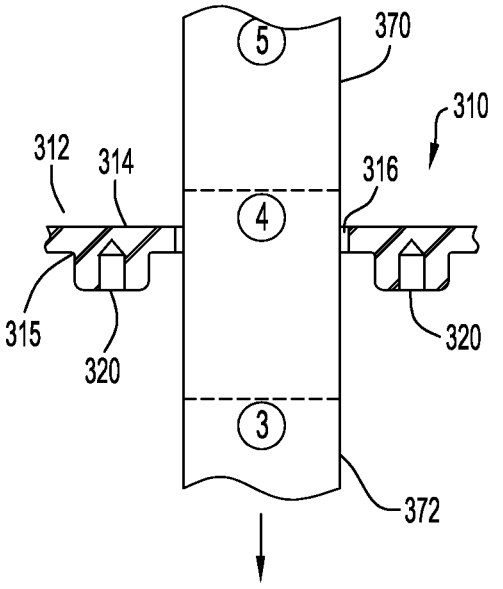
Figure 9D:
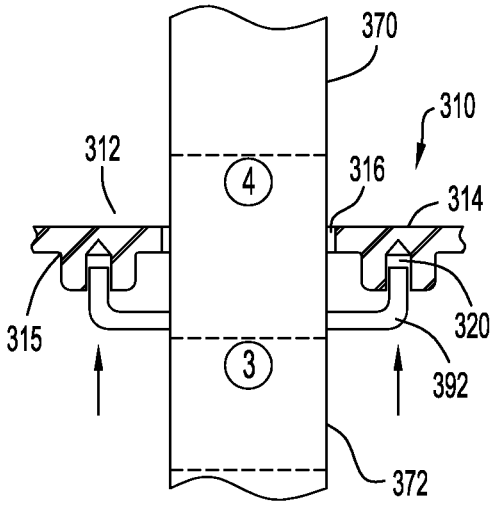

The position of the child support member 310 can be repeatedly adjusted as illustrated in FIGS. 9A-9D. As shown in FIG. 9A, the user first removes the retainer 392 from the bottom surface 315 of the attachment portion 312. The user then removes the retainer 392 from the opening 378 of the sleeve (FIG. 9B) and repositions the second end portion 372 of the resilient member 370 as desired (FIG. 9C). Finally, as shown in FIG. 9D, the user reinserts the retainer 392 into the opening 378 of the desired sleeve and couples the retainer 392 to the bottom surface 315 by inserting the ends of the retainer 392 into the mating holes 320.

Figure 10A:
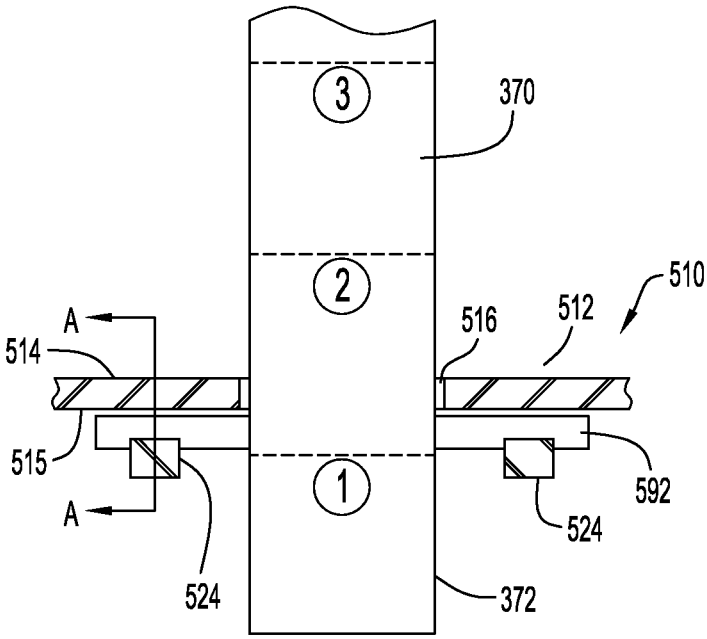
FIG. 10A is a cross-sectional view of an attachment portion of a jumping device according to an embodiment of the invention.
Figure 10B:
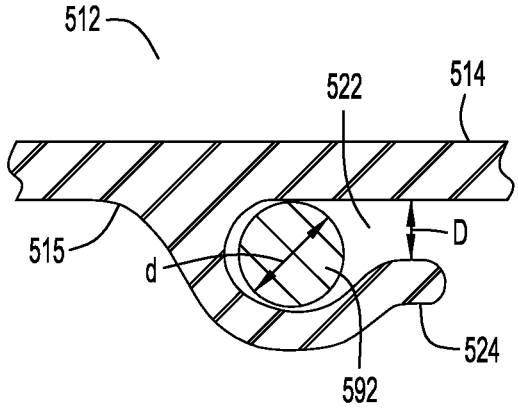
FIG. 10B is a cross-sectional view taken along section A-A of the attachment portion of the jumping device illustrated in FIG. 10A.

Although retainer 392 illustrated in FIG. 8 is coupled to the bottom surface 315 of the attachment portion 312 via mating holes 320, other suitable coupling mechanisms are contemplated. For example, in the embodiment shown in FIGS. 10A and 10B, a child support member 510 includes an attachment portion 512 having a top surface 514 and a bottom surface 515. The attachment portion 512 defines an opening 516 between the top surface 514 and the bottom surface 515 that receives the second end portion 372 of the resilient member 370, as described above. The bottom surface 515 includes two clip portions 524, each defining an opening 522 configured to receive a portion of the retainer 592. As illustrated in FIG. 10B, the depth D at the entry portion of each opening 522 is smaller than the diameter d of retainer 592, thereby allowing the retainer 592 to be securely coupled to the bottom surface 515 of the attachment portion 512. The retainer 592 can be removed from the opening 522 by displacing the edge of the clip portion 524 away from the bottom surface 515 of the attachment portion 512, thereby increasing the depth D.

In illustrated embodiment, the attachment portion 512 is monolithically formed to include the clip portions 524. In other embodiments, however, the clip portions 524 are separate components, such as, for example, thin metallic strips, coupled to the bottom surface of the attachment portion. In yet other embodiments, the openings are defined by a single clip portion.

Figure 11:
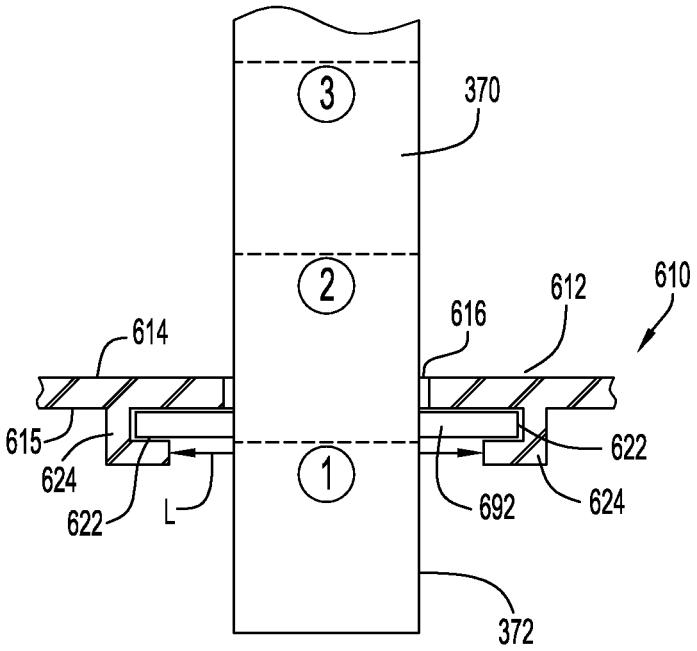
FIG. 11 is a cross-sectional view of an attachment portion of a jumping device according to an embodiment of the invention.
Figure 12:
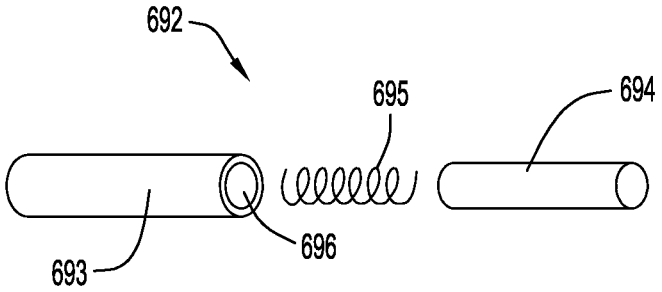
FIG. 12 is an exploded view of the retainer illustrated in FIG. 11.

Another mechanism for coupling the retainer to the attachment portion includes a variable length retainer 692 as illustrated in FIGS. 11 and 12. The retainer 692 includes a first end portion 693, a second end portion 694 and a biasing member 695. The first end portion includes a bore 696 configured to slidably receive a portion of the second end portion 694. As illustrated in FIG. 12, the biasing member 695 is disposed within the bore 696 such that it exerts an force on the first end portion 693 and the second end portion 694. In use, the length of the retainer 692 can be varied by applying an external force to the end portions 693, 694 such that the second end portion 694 is pushed further into the bore 696 of the first end portion 693.

As illustrated in FIG. 11, a child support member 610 includes an attachment portion 612 having a top surface 614 and a bottom surface 615, as described above. The attachment portion 612 defines an opening 616 between the top surface 614 and the bottom surface 615 that receives the second end portion 372 of the resilient member 370, as described above. The bottom surface 615 includes two clip portions 624, defining two opposing openings 622. Each opening 622 is configured to receive an end portion 693, 694 of the retainer 692. In use, the retainer 692 is inserted into the openings 622 by applying a force to the end portions 693, 694 (i.e., squeezing the end portions together), until the length of the retainer 692 is less than the distance L between the clip portions 624. The retainer 692 is then inserted into the openings 622 and released. The retainer is secured in place by the force exerted by the biasing member 695.

Figure 13:
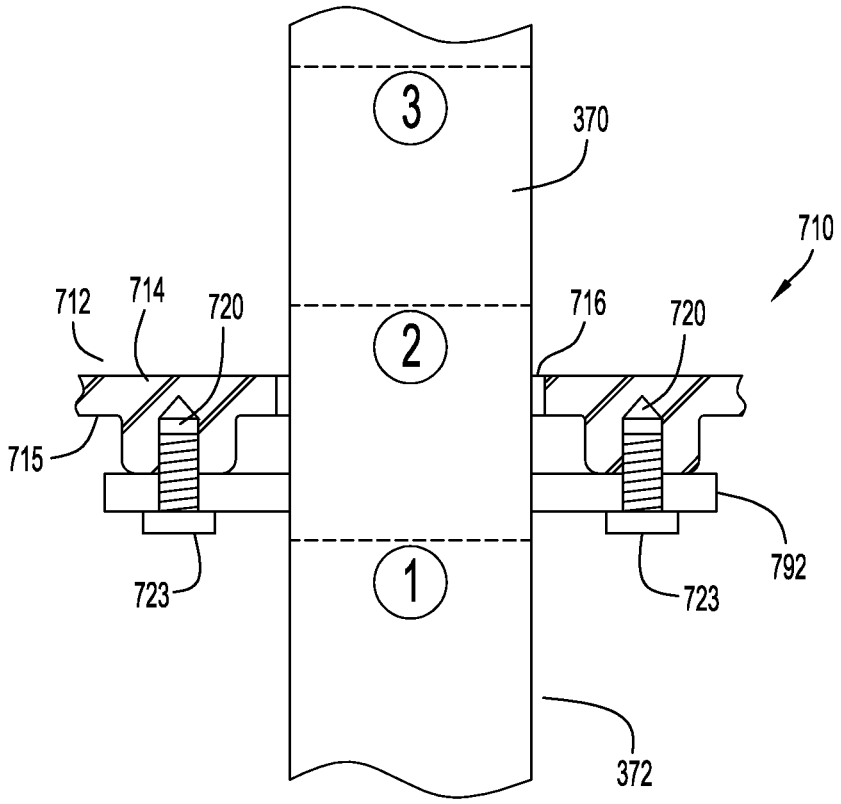
FIG. 13 is a cross-sectional view of an attachment portion of a jumping device according to an embodiment of the invention.

FIG. 13 illustrates yet another embodiment in which a retainer 792 is secured to a bottom surface 715 of an attachment portion 712 by one or more fasteners 723. In the illustrated embodiment, a child support member 710 includes an attachment portion 712 having a top surface 714 and a bottom surface 715. As described above, the attachment portion 712 defines an opening 716 through which the second end portion 372 of the resilient member 370 is disposed. The bottom surface 715 of the attachment portion 712 defines a set of holes 720, each configured to receive a fastener 723. In use, the retainer 792 is removably coupled to the bottom surface 715 by the fasteners 723. The fasteners 723 can be, for example, threaded screws, locking pins, and the like.

Figure 14:
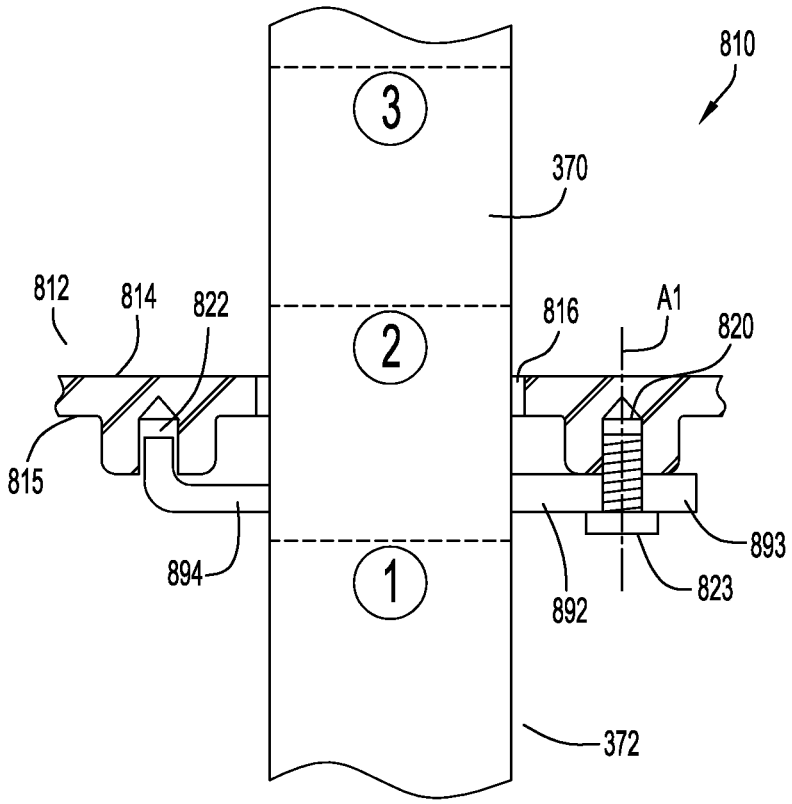
FIG. 14 is a cross-sectional view of an attachment portion of a jumping device according to an embodiment of the invention.

FIG. 14 illustrates yet another embodiment in which a retainer 892 is pivotably coupled to a child support member 810. In the illustrated embodiment, a child support member 810 includes an attachment portion 812 having a top surface 814 and a bottom surface 815. As described above, the attachment portion 812 defines an opening 816 through which the second end portion 372 of the resilient member 370 is disposed. The bottom surface 815 of the attachment portion 812 defines a hole 820 and a slot 822. The hole 820 is configured to receive a fastener 823, thereby allowing a first portion 893 of the retainer 892 to be pivotably coupled to the child support member 810. The slot 823 is configured to receive a second portion 894 of the retainer 892. In use, the position of the child support member 810 can be adjusted by rotating the retainer 892 about axis A1 between a first (locked) position, in which the second portion 894 of the retainer 892 is disposed within the slot 822, and a second (unlocked) position, in which the second portion 894 of the retainer 892 is not disposed within the slot 822. When the retainer 892 is in the second position, a sleeve (not shown) of resilient member 370 can be removed from the retainer 892 and repositioned accordingly. In this manner, the position of the child support member 810 can be repeatedly adjusted without removing the retainer 892 from the child support member 810.

In some embodiments, the first portion 893 of the retainer 892 can be pivotably coupled to the child support member 810 without a fastener 823. For example, in some embodiments, the first portion of the retainer can be configured to snap into the hole, thereby pivotably coupling the retainer to the child support member.

In some embodiments, the retainer is securely coupled to the bottom surface of the attachment portion by a spring loaded clasp. In other embodiments, the retainer is securely coupled to the bottom surface of the attachment portion by one or more elastic bands configured to receive an end portion of the retainer. In yet other embodiments, the retainer is securely coupled to the bottom surface of the attachment portion by a magnetic force.

The retainer 392 can be fabricated from a variety of different materials and have a variety of different shapes. For example, in some embodiments, the retainer can have a circular cross-section, as shown in FIGS. 10B and 12. In other embodiments, the retainer 392 can be a flat plate having a rectangular cross-section. In yet other embodiments, the retainer 392 can have an arcuate shape. Similarly, the retainer 392 can be fabricated from an alloy, a plastic, a composite, or any other suitable material.

In some embodiments, the tray portion 308 of the child support member 310 is monolithically formed to include the attachment portion 312. In other embodiments, the attachment portion is a separate component coupled to the child support member.

Figure 15A:
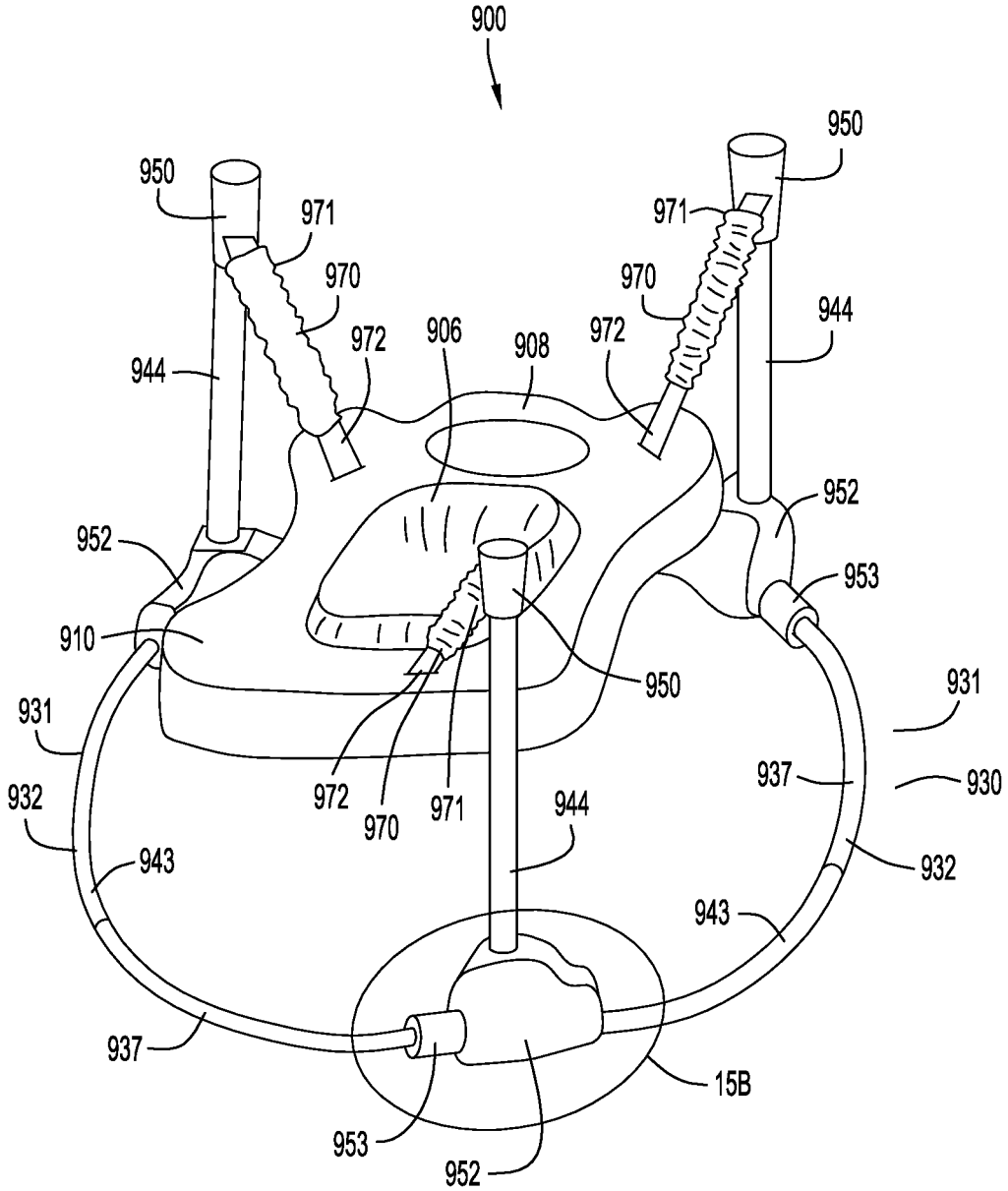
FIG. 15A is a perspective view of a jumping device having a support frame having three frame portions according to an embodiment of the invention.

FIG. 15A illustrates a jumping device 900 according to an embodiment of the invention that includes a support frame 930, three resilient members 970 and a child support member 910. The child support member 910 includes a tray portion 908 and a seat 906. The resilient members 970 are similar to those described above, each having a first end portion 971 coupled to the support frame 930 and a second end portion 972 coupled to the child support member 910. In this manner, the child support member 910 is suspended from the support frame 930 by the resilient members 970.

In some embodiments, the position of the child support member 910 relative to the support frame 930 can selectively adjustable, as described above. For example, in some embodiments, the second end portion 972 of each of the resilient members 970 can include a set of sleeves (not shown), each sleeve being configured to receive a portion of a retainer (not shown). The retainer can be configured to be coupled to the child support member 910 such that a portion of the retainer can be repeatably disposed within a different sleeve from the set of sleeves, thereby allowing the position of the child support member 910 to be adjusted. In other embodiments, the second end portion 972 is fixedly coupled to the child support member 910. In yet other embodiments, the sleeve and retainer feature can be configured to adjust the position of the child support member 910 at the first end portion 971 of the resilient members 970.

The support frame 930 includes three frame portions 931, each including an upright portion 944 and a base portion 932. Each base portion 932 includes a first base member 943 and a second base member 937, a portion of which is configured to be disposed within the first base member 943. In this manner, the base portions 932 can be selectively placed in an expanded configuration when the jumping device 900 is in use and a more compact configuration when the jumping device 900 is not in use. In some embodiments, for example, the first base member 943 and the second base member 937 are tubes, with the inner diameter of the first base member 943 being larger than the outer diameter of the second base member 937, thereby allowing a portion of the second base member 943 to be slidably disposed within the first base member 943. In some embodiments, the base portions 932 can include a locking mechanism, such as a detent, configured to securely maintain the base portion 932 in the desired (e.g., assembled or disassembled) configuration. In yet other embodiments, the base portion 932 does not include a first base member 943 and a second base member 937, but is rather a single, monolithically formed portion of the frame portion 931.

Figure 15B:
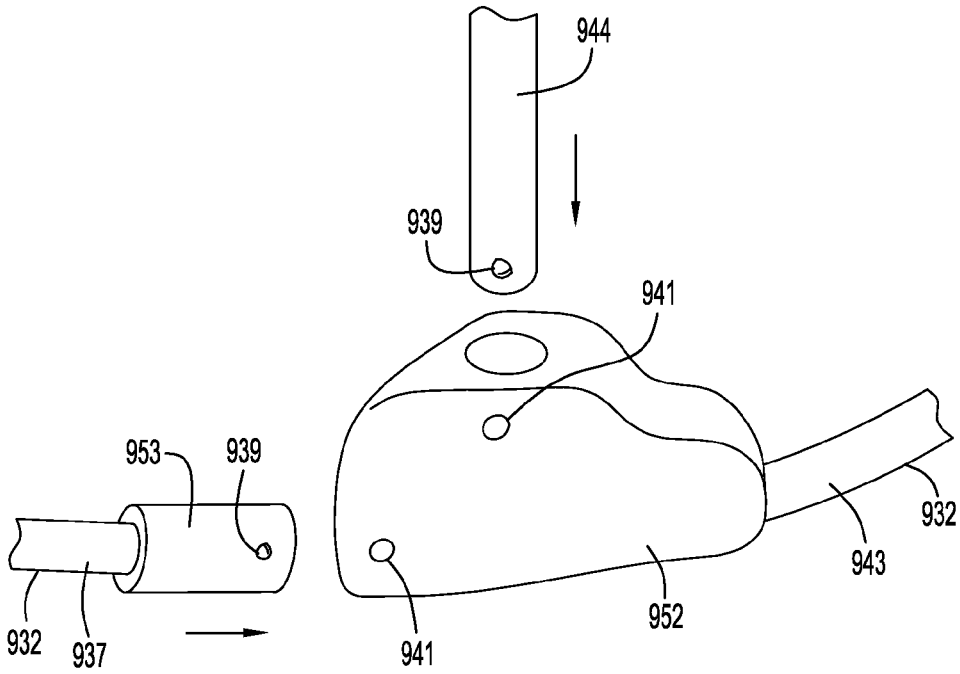
FIG. 15B is a perspective view of the region marked 15B of the jumping device illustrated in FIG. 15A.

The first base member 943 of each base portion 932 includes a first connector 952 and the second base member 937 of each base portion 932 includes a second connector 953. The second connector 953 of one of the frame portions 931 is configured to engage the first connector 952 of another of the frame portions 931 such that the three frame portions 931 can be interconnected to form the support frame 930, as illustrated in FIG. 15A. As illustrated in the exploded view in FIG. 15B, in some embodiments, the first connector 952 can be a female connector configured to receive a male portion of the second connector 953. The second connector 953 can include a locking mechanism 939, such as a tab, detent and the like, configured to be received by a mating portion 941, such as a hole, located on the first connector 952. In other embodiments, the connectors can be of any type suitable for removably coupling the frame portions together. In some embodiments, for example, the first and second connectors 952, 953 can be separate components coupled to the first and second base members 943, 937, respectively, as illustrated in FIGS. 15A and 15B. In other embodiments, the base members can be monolithically formed to include the connectors.

The upright portion 944 of each frame member 931 includes an attachment portion 950 configured to engage the first end portion 971 one of the resilient members 970. In some embodiments, the attachment portion 950 can be a separate component coupled to the upright portion. In other embodiments the attachment portion 950 is not a separate component, but rather, is integral to the upright portion 944 of the frame members 931.

In some embodiments the first end portion 971 is fixedly attached to the attachment portion 950. For example, the first end portion 971 can be molded into a portion of the attachment portion 950. In other embodiments, the first end portion 971 is removably attached to the attachment portion 950. For example, the first end portion 971 can be adjustably coupled to the attachment portion 950 by a sleeve-and-retainer combination of the type described above.

In some embodiments, the upright portion 944 of each frame member 931 can be removably coupled to the first connector 952. In this manner, the frame members 931 can be conveniently disassembled for storage purposes when the jumping device 900 is not in use. As illustrated in FIG. 15B, the first connector 952 can be configured to receive a portion of the upright portion 944. The upright portion 944 can include a locking mechanism 939, such as a tab, detent and the like, configured to be received by a mating portion 941, such as a hole, located on the first connector 952.

As discussed above, the support frame can be selectively placed in an expanded configuration when the jumping device is in use and a more compact, collapsed configuration when the jumping device is not in use. FIGS. 16A-16D are schematic plan view illustrations of a support frame 1030 according to an embodiment of the invention in a various different configurations. The support frame 1030 includes three frame portions 1031, each including an upright portion 1044 and a base portion 1032. Each base portion 1032 includes a first base member 1043 and a second base member 1037, a portion of which is configured to be disposed within the first base member 1043.

Figure 16A:
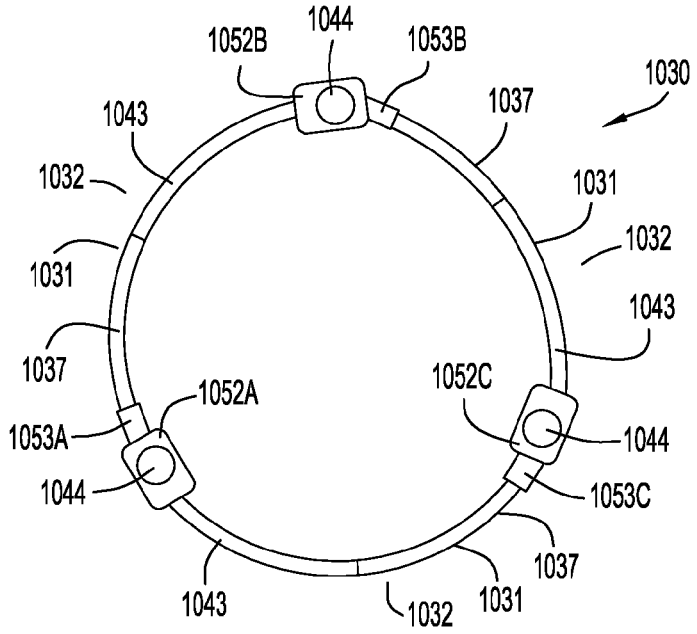
FIGS. 16A-16D are schematic plan view illustrations of a support frame according to an embodiment of the invention in various different positions.
Figure 16B:
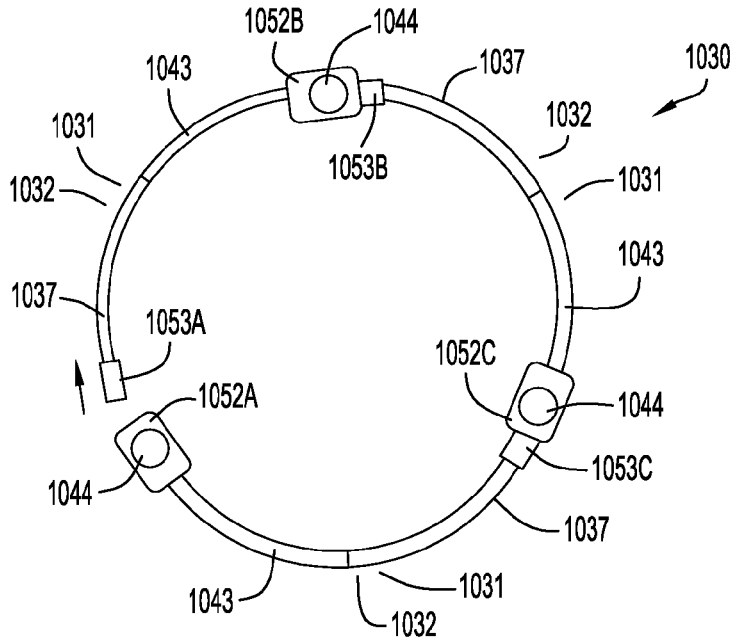
Figure 16C:
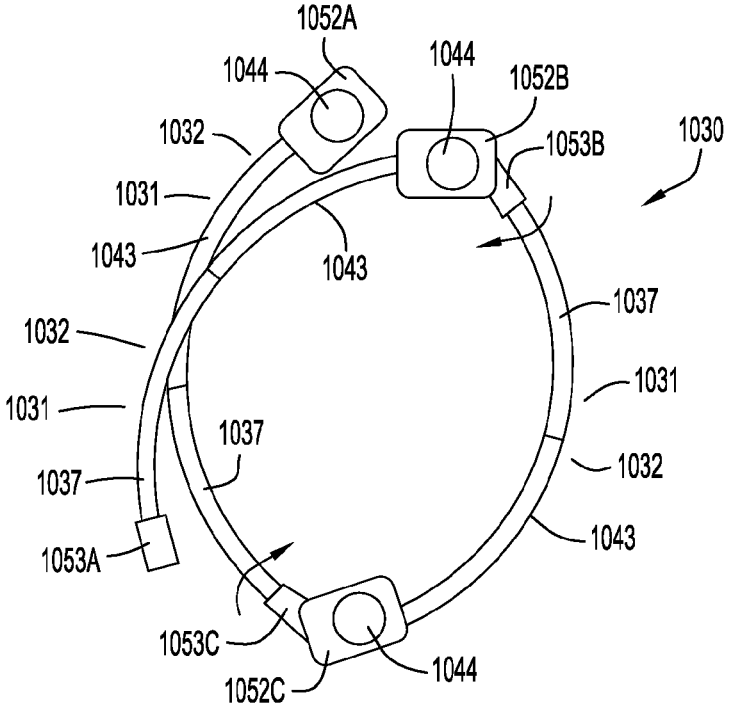
Figure 16D:
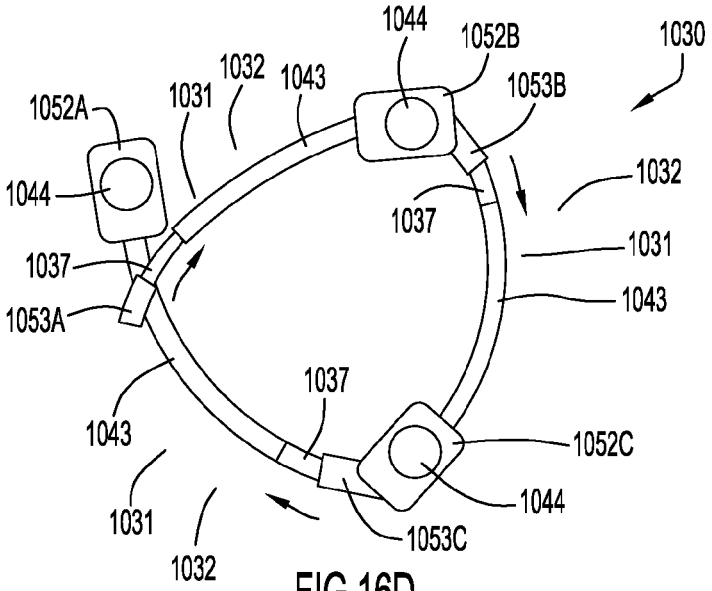

As described above, the first base member 1043 of each base portion 1032 includes a first connector 1052 and the second base member 1037 of each base portion 1032 includes a second connector 1053. The second connector 1053 of one of the frame portions 1031 is configured to engage the first connector 1052 of another of the frame portions 1031 such that the three frame portions 1031 can be interconnected to form the support frame 1030, as illustrated in FIG. 16A. In some embodiments, the mating connectors can be configured to removably engage each other as described above, such that the frame portions can be removably interconnected. In other embodiments, the mating connectors can be configured to pivotably engage each other such that frame portions can be pivotably interconnected, thereby allowing the frame portions to be foldably placed in a collapsed configuration when the jumping device is not in use. In yet other embodiments, the mating connectors can be configured to both removably and pivotably engage each other.

As illustrated in FIGS. 16A-16D, in some embodiments, some of the mating connectors are configured to removably engage each other, while other of the mating connectors are configured to pivotably engage each other. In use, the support frame 1030 can be repeatably transitioned from an expanded configuration (FIG. 16A) to a collapsed configuration (FIG. 16D) as described herein. The second connector 1053A is removed from the first connector 1052A, as shown by the arrow in FIG. 16B. Each of the second connectors 1053B and 1053C are then pivoted within the first connectors 1052B and 1052C, respectively, as shown by the arrows in FIG. 16C. In this manner, the frame portions 1031 can be pivoted with respect to each other, thereby allowing the support frame 1030 to be placed in a more compact configuration. Finally, as shown by the arrows in FIG. 16D, each of the second base members 1037 is disposed within the respective first base member 1043.

Figure 17:
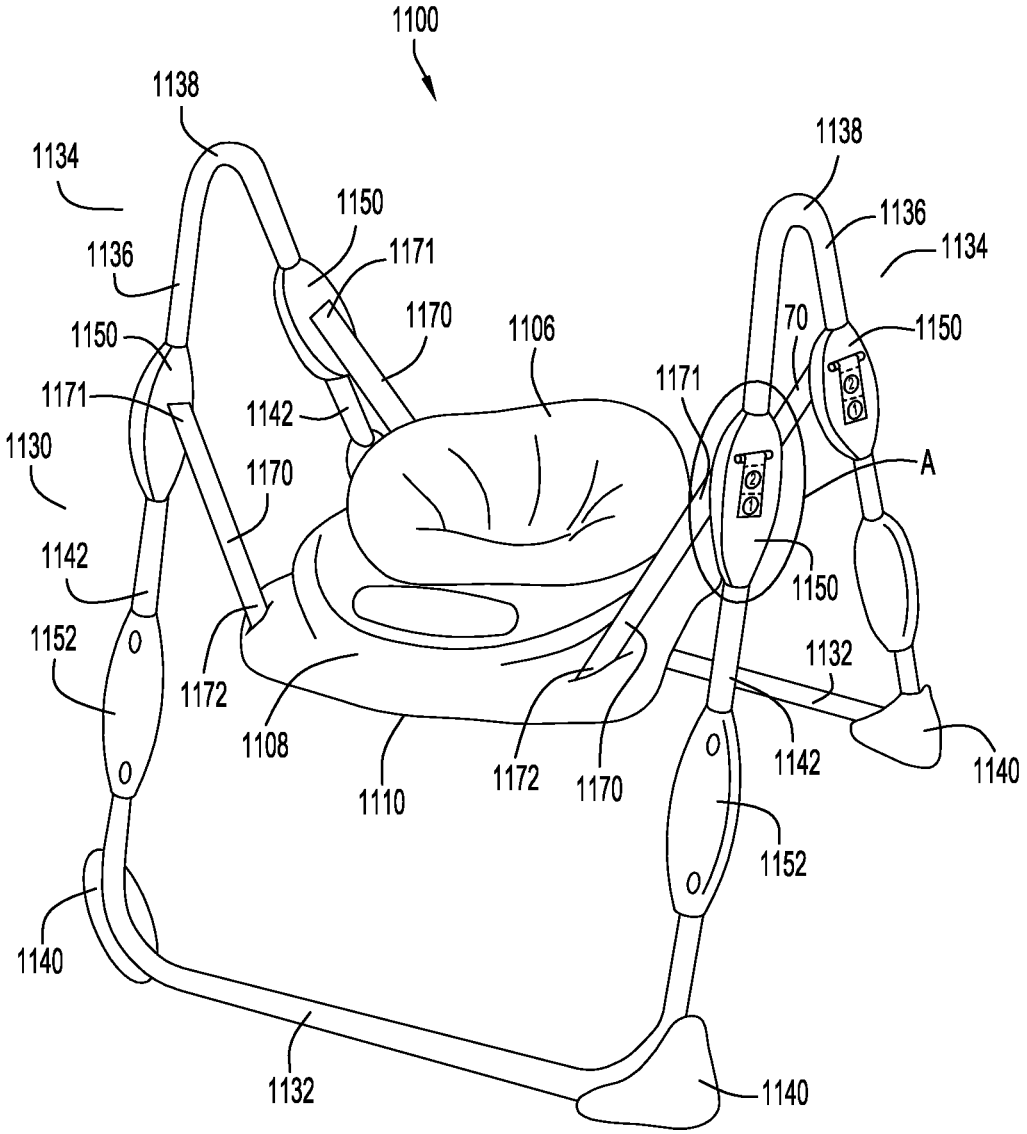
FIG. 17 is a perspective view of a jumping device according to an embodiment of the invention.
Figure 18:
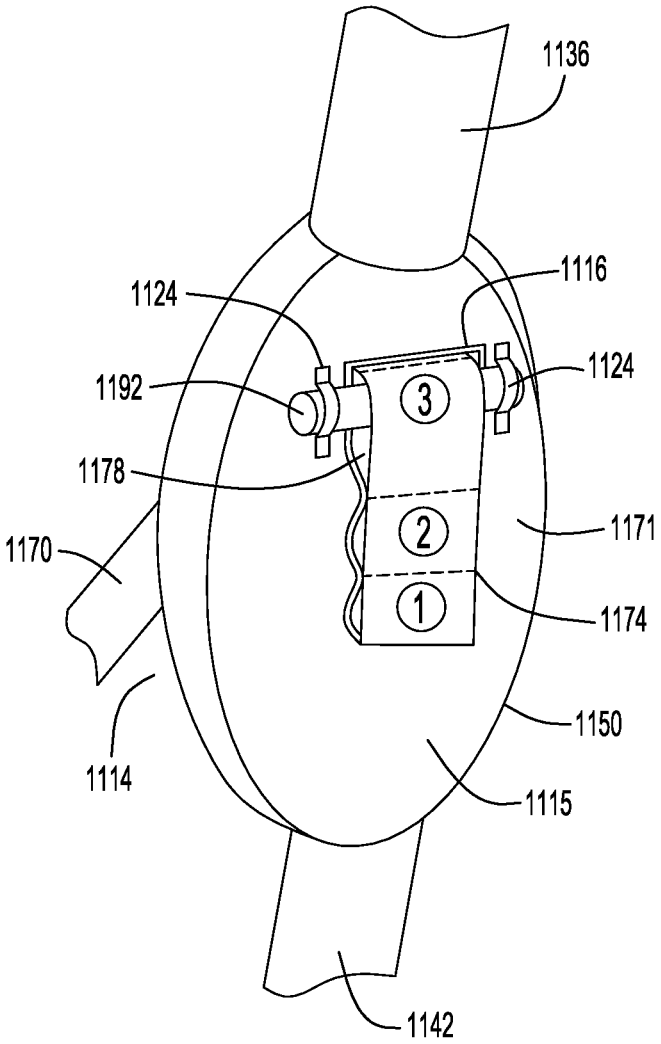
FIG. 18 is a perspective view of a portion of the jumping device illustrated in FIG. 17.

FIGS. 17 and 18 illustrate a jumping device 1100 according to an embodiment of the invention that includes a support frame 1130, four resilient members 1170, a child support member 1110 and a retainer 1192 associated with each resilient member 1170 (see FIG. 15). As described above, the child support member 1110 includes a tray portion 1108 and a seat 1106. The resilient members 1170 are similar to those described above, each having a first end portion 1171 having a set of sleeves 1174 and a second end portion 1172. The second end portion 1172 is coupled to the child support member 1110. A portion of each retainer 1192 is disposed within a sleeve from the set of sleeves 1174 (see FIG. 18). Each retainer 1192 is coupled to the support frame 1130, thereby coupling the first end portion 1171 of each resilient member 1170 to the support frame 1130 such that the child support member 1110 is suspended from the support frame 1130. As described above, the position of the child support member 1110 relative to the support frame 1130 is selectively adjustable by disposing the portion of each retainer 1192 within a different sleeve from the set of sleeves 1174 in each resilient member 1170.

As illustrated in FIG. 17, the support frame 1130 includes two A-shaped portions 1134 spaced laterally from and opposite each other. Each A-shaped portion 1134 includes a top portion 1136 that defines an apex 1138 and two mid portions 1142. An attachment member 1150 is disposed between each mid portion 1142 and the top portion 1136. As discussed in more detail herein, the attachment members 1150 also serve to attach the resilient members 1170 to the support frame 1130. The A-shaped portions 1134 are coupled together by two base members 1132, one positioned towards the front of the jumping device 1100 and one positioned towards the rear of the jumping device 1100. The ends of the base members 1132 are coupled to the mid portions 1142 of the A-shaped portion 1134 by connectors 1152.

The base members 1132 are substantially U-shaped and include feet 1140 attached at the ground-engaging corners of each base member 1132. The feet 1140 are configured to substantially contact a support surface when the jumping device 1100 is in a deployed configuration. The feet 1140 are slip-resistant to help maintain the jumping device 1100 in a desired location. The feet 1140 can be, for example, plastic, rubber or any other suitable material.

In some embodiments, the connectors 1152 are configured to slidably receive the ends of the base members 1132 and the mid portions 1142 and include a height adjustment mechanism. The operation of such a height adjustment mechanism is described in U.S. Pat. No. 6,932,709, entitled "Free-Standing Jumping Device," which is incorporated herein by reference in its entirety. In other embodiments, the connectors 1152 include a quick-connect mechanisms that allow for the base members 1132 to be easily removed for storage purposes.

In some embodiments, the mid portions 1142 and the top portion 1136 are separate components joined by the attachment member 1150. In some embodiments, for example, an end portion of each mid portion 1142 is pivotably coupled to its adjacent attachment member 1150. In other embodiments, only the two mid portions 1142 towards the front of the jumping device 1100 are pivotably coupled to their adjacent attachment members 1150, while the two mid portions 1142 towards the rear of the jumping device 1100 are fixedly coupled to their adjacent attachment members 1150. In this manner, the jumping device 1100 can be conveniently folded for storage purposes. In yet other embodiments, the attachment members 1150 include a quick-connect mechanisms that allow for easy removal of the mid portions 1142 and/or the top portions 1136.

As illustrated, the attachment members 1150 also serve to attach the resilient members 1170 to the support frame 1130 in a position beneath the apex 1138 of the A-shaped portions 1134 of the support frame 1130. Similar to the attachment portion described above, each attachment member 1150 has a first surface 1114 and a second surface 1115. The attachment member 1150 defines an opening 1116 between the first surface 1114 and the second surface 1115 that receives the first end portion 1171 of the resilient member 1170. A portion of the retainer 1192 is disposed within the opening 1178 of a sleeve from the set of sleeves 1174 and the retainer 1192 is coupled to the second surface 1115 of the attachment member 1150. In the illustrated embodiment, a set of clips 1124 is coupled to the second surface 1115 of the attachment member 1150. The clips 1124 are configured to receive a portion of the retainer 1192 such that the retainer 1192 can be securely coupled to the second surface 1115 of the attachment member 1150.

As shown and described above, many other mechanisms for coupling the retainer 1192 to the second surface 1115 of the attachment member 1150 are contemplated. Similarly, although the attachment member 1150 is shown and described as a separate component disposed between a top portion 1136 and a mid portion 1142 of an A-shaped portion 1134, in some embodiments, the A-shaped portions are monolithically formed to include an attachment portion performing the functions of the attachment member 1150 as described above.

In the illustrated embodiment, the second end portion 1172 is coupled to the child support member 1110. In some embodiments the second end portion 1172 is fixedly attached to the child support member 1110. For example, the second end portion 1172 can be molded into the tray portion 1108 of the child support member 1110. In other embodiments, the second end portion 1172 is removably attached to the child support member 1110. For example, the second end portion 1172 of the resilient member 1170 can be coupled to the child support member 1110 by a fastener, an elastic strap, or by a sleeve-and-retainer combination.

Figure 19:
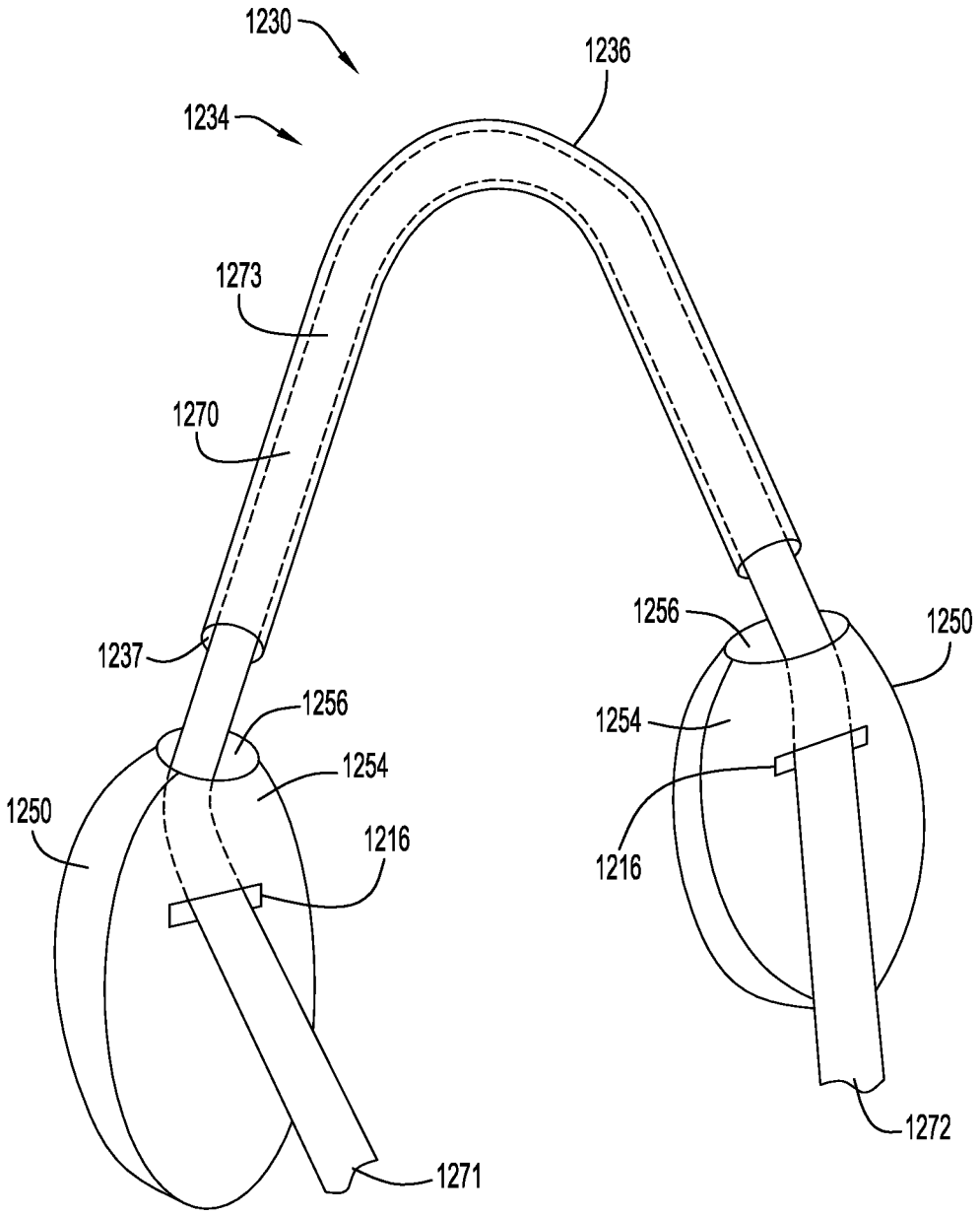
FIG. 19 is a perspective view of a portion of a support frame of a jumping device according to an embodiment of the invention.

Although the A-frame jumping device 1100 is shown and described as having four resilient members 1170, each of which is adjustably attached to the support frame 1130, in some embodiments, a jumping device includes only two resilient members, the ends of which are attached to a child support member. For example, FIG. 19 illustrates a portion of an A-shaped portion 1234 of a support frame 1230 according to an embodiment of the invention. The A-shaped portion 1234 includes a tubular top portion 1236 that defines an interior region 1237. The ends of the top portion 1236 are coupled to attachment members 1250. Each attachment member 1250 includes a side wall 1254 that defines an interior region 1256. The side wall 1254 further defines an opening 1216 that receives a portion of the resilient member 1270. As illustrated, the resilient member 1270 is disposed through each opening 1216 such that its first end portion 1271 and its second end portion 1272 are disposed outside of the A-shaped portion 1234 of the support frame 1230, while a central portion 1273 of the resilient member is disposed within the interior region 1237 of the top portion 1236. In this manner, the first end portion 1271 and the second end portion 1272 can each be coupled to a child support member (not shown), while the central portion 1273 cooperates with the top portion 1236 to support the child support member (not shown).

In some embodiments, each of the first end portion 1271 and the second end portion 1272 include a set of sleeves (not shown) and are adjustably coupled to the child support member (not shown). In other embodiments, one of the end portions is fixedly coupled to the child support member, while the other end portion includes a set of sleeves and is adjustably coupled to the child support member in a manner as described above.

In some embodiments, a portion of the resilient member 1270 is not disposed within the support frame 1230. For example, in some embodiments, the support frame includes a series of eyelets or rings through which the resilient member is disposed.

Figure 20:
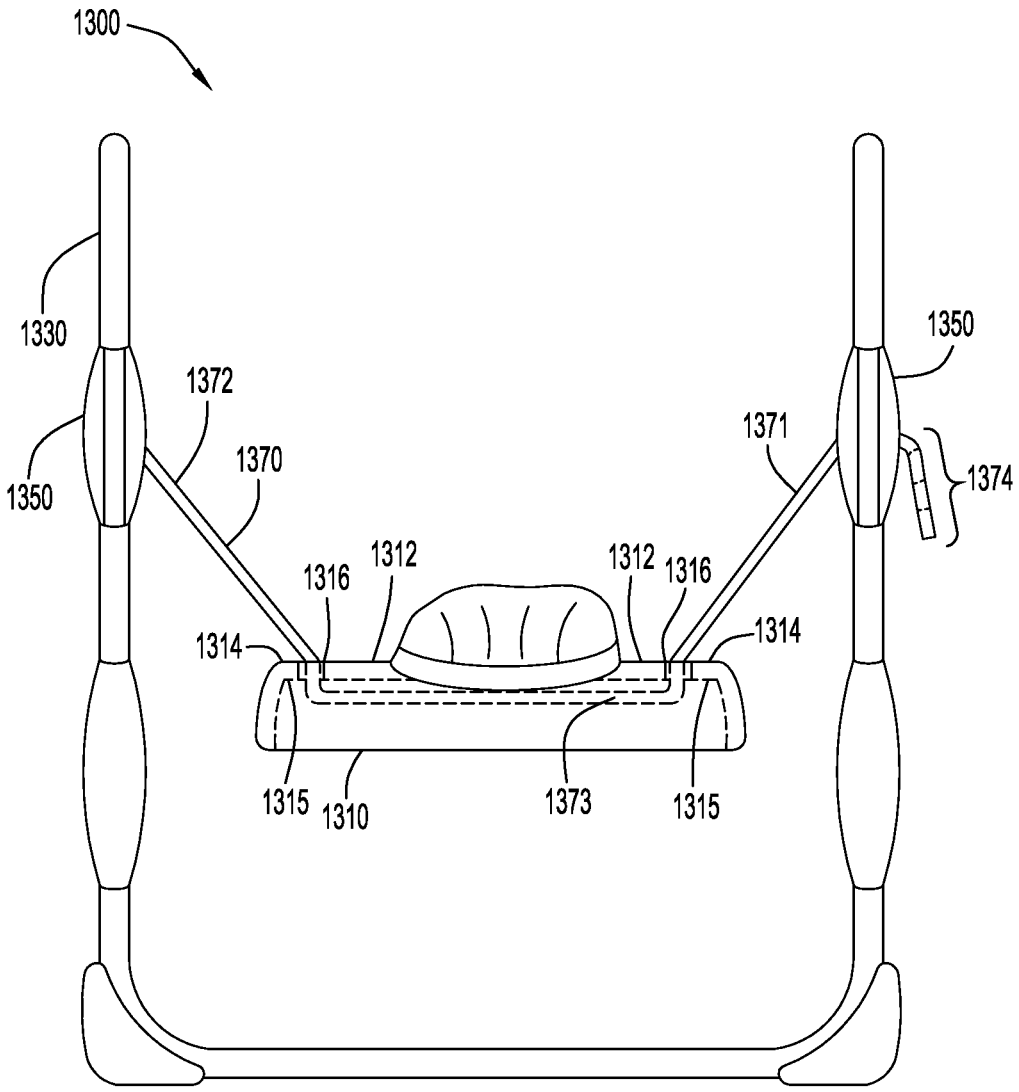
FIG. 20 is a front view of a jumping device according to an embodiment of the invention.
Figure 21:
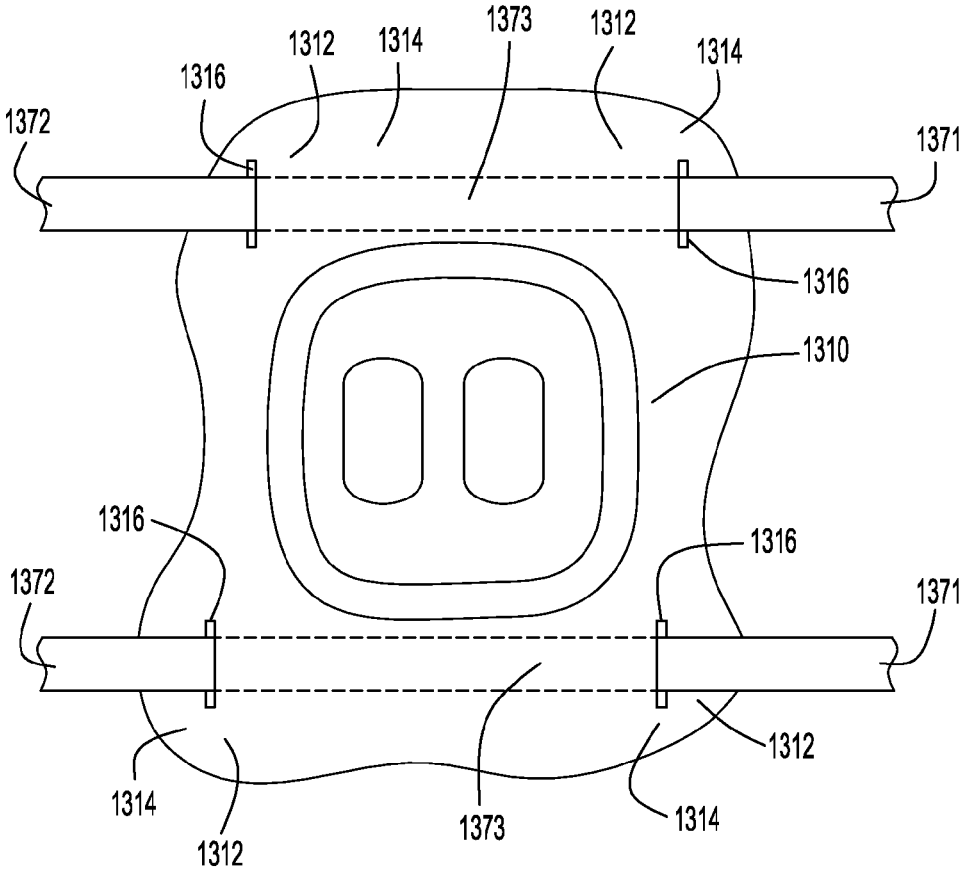
FIG. 21 is a plan view of a portion of the jumping device illustrated in FIG. 20.

FIGS. 20 and 21 illustrate a jumping device 1300 similar to the jumping device 800 described above, except that the jumping device 1300 includes only two resilient members 1370, one of which is disposed towards the front of the jumping device and one of which is disposed towards the rear of the jumping device. In the illustrated embodiment, the resilient members 1370 have a first end portion 1371, a second end portion 1372 and a central portion 1373. The first end portion 1371 includes a set of sleeves 1374 and is adjustably coupled to an attachment member 1350 of the support frame 1330 in a manner similar to that described above. The second end portion is fixedly coupled to an attachment member 1350 of the support frame 1330. The central portion 1373 is coupled to the child support member 1313 such that the child support member 1313 is suspended by the resilient members 1370.

In the illustrated embodiment, the child support member includes attachment portions 1312, each of which includes a top surface 1314 and a bottom surface 1315. The attachment portions 1312 define openings 1316 between the top surface 1314 and the bottom surface 1315 that receive a portion of the resilient member 1370. In this manner, central portion 1373 is coupled to the bottom surface 1315 of the attachment portions. Although the illustrated child support member 1313 is monolithically formed to include the attachment portions 1312, in some embodiments the attachment portions are separate components coupled to the child support member. In yet other embodiments, the attachment portions are configured such that the central portions of the resilient members are coupled to the top surface of the attachment portions.

Figure 22:
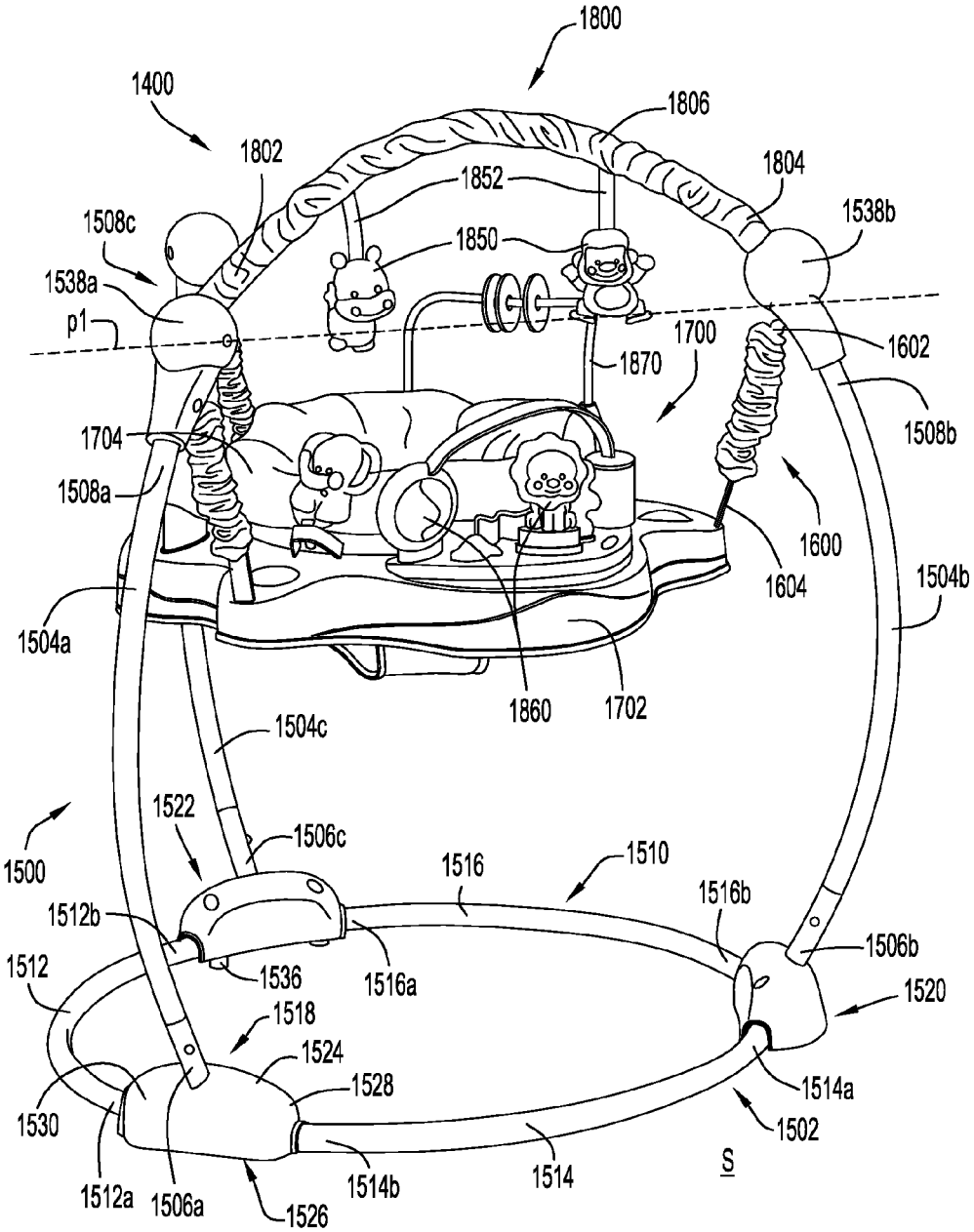
FIG. 22 is a perspective view of an infant support structure according to an embodiment of the invention.

FIG. 22 illustrates an infant support structure 1400 according to an embodiment of the invention that includes a support frame 1500, three resilient members 1600, a child support member or seat portion 1700 configured to received an infant, and a toy bar 1800. The seat portion 1700 includes a tray portion 1702 and a seat 1704. In one embodiment, the resilient members 1600 are similar to those described above, each having a first end portion 1602 coupled to the support frame 1500 and a second end portion 1604 coupled to the seat portion 1700. Thus, the seat portion 1700 is movably suspended from the support frame 1500 by the resilient members 1600.

In some embodiments, the position of the seat portion 1700 relative to the support frame 1500 is selectively adjustable. For example, in some embodiments, the second end portion 1604 of each of the resilient members 1600 includes a set of sleeves, as described above. Thus, each sleeve is configured to receive a portion of a retainer coupled to the seat portion 1700.

The support frame 1500 includes a lower portion 1502 configured to engage a support surface, and a plurality of posts 1504*a*, 1504*b*, 1504*c* extending upwardly from the lower portion 1502. Post 1504*a* includes a lower end portion 1506*a* coupled to the lower portion 1502 and an upper distal end portion 1508*a*. Similarly, post 1504*b* includes a lower end portion 1506*b* coupled to the lower portion 1502 and an upper distal end portion 1508*b*, and post 1504*c* includes a lower end portion 1506*c* coupled to the lower portion 1502 and an upper distal end portion 1508*c*. Posts 1504*a*, 1504*b*, 1504*c* may be formed from tubular material. In one embodiment, posts 1504*a*, 1504*b* and/or 1504*c* have an arcuate configuration and bow outwardly from a perimeter 1510 of the lower portion 1502. Posts 1504*a*, 1504*b*, 1504*c* are circumferentially spaced, and in one embodiment substantially uniformly spaced about the perimeter 1510 of the lower portion 1502 and about the seat portion 1700.

In one embodiment, the lower portion 1502 includes a plurality of tubular sections 1512, 1514, 1516 that are coupled together to define the perimeter 1510. Section 1512 includes opposite ends 1512*a* and 1512*b*. Section 1514 includes opposite ends 1514*a* and 1514*b*. Section 1516 includes opposite ends 1516*a* and 1516*b*. In one embodiment, end 1512*a* is coupled to end 1514*b* via a connector 1518, end 1514*a* is coupled to end 1516*b* via another connector 1520, and end 1512*b* is coupled to end 1516*a* via another connector 1522. In another embodiment, the lower portion 1502 is formed from fewer or more than three sections 1512, 1514, 1516. For example, in one embodiment the lower portion 1502 is one integrally formed component.

The lower end portion 1506*a* of post 1504*a* is coupled to and extends upwardly from connector 1518. The lower end portion 1506*b* of post 1504*b* is coupled to and extends upwardly from connector 1520. The lower end portion 1506*c* of post 1504*c* is coupled to and extends upwardly from connector 1522.

In one embodiment, each connector 1518, 1520, 1522 includes an upper side 1524, an opposite underside 1526, and opposing end walls 1528, 1530. The upper side 1524 of the connector 1518 includes or defines a coupling mechanism and/or a recess configured to receive and secure the lower end portion 1506*a* of post 1504*a* (or the lower end portion 1506*b* of post 1504*b* or the lower end portion 1506*c* of post 1504*c*). The lower end portion 1506*a* (or the lower end portion 1506*b* or the lower end portion 1506*c*) may be secured to the coupling mechanism on the associated connector 1518 (or connector 1520 or connector 1522) via pins, screws, adhesive, or other fasteners. Alternatively, the lower end portion 1506*a* (or the lower end portion 1506*b* or the lower end portion 1506*c*) may be releasably coupled to the associated connector 1518 (or connector 1520 or connector 1522), such as via a friction fit within the corresponding recess in the corresponding connector 1518, 1520 or 1522.

Each of end walls 1528, 1530 includes or defines a coupling mechanism and/or a recess configured to receive and secure the end 1512*a* (or 1512*b* or 1514*a* or 1514*b* or 1516*a* or 1516*b*) of a corresponding one of the sections 1512, 1514, 1516. The ends 1512*a*, 1512*b*, 1514*a*, 1514*b*, 1516*a*, 1516*b* of the sections 1512, 1514, 1516 may be secured to an associated connector 1518, 1520, 1522 via pins, screws, adhesive, or other fasteners. Alternatively, one or more of the ends 1512*a*, 1512*b*, 1514*a*, 1514*b*, 1516*a*, 1516*b* of the sections 1512, 1514, 1516 may be releasably coupled to the associated connector 1518, 1520, 1522, such as via a friction fit within the corresponding recess. The underside 1526 of each of the connectors 1518, 1520, 1522 may include a nonslip material such as an elastomeric material. In one embodiment, a plurality of nonslip foot members 1536 are disposed on the underside 1526 of each connector 1518, 1520, 1522.

With continued reference to FIG. 22, in one embodiment each section 1512, 1514, 1516 of the lower portion 1502 has a generally arcuate configuration and curves outwardly from the corresponding connectors 1518, 1520, 1522 to which it is connected. In one embodiment, the lower portion 1502 has a substantially circular configuration.

Figure 23:
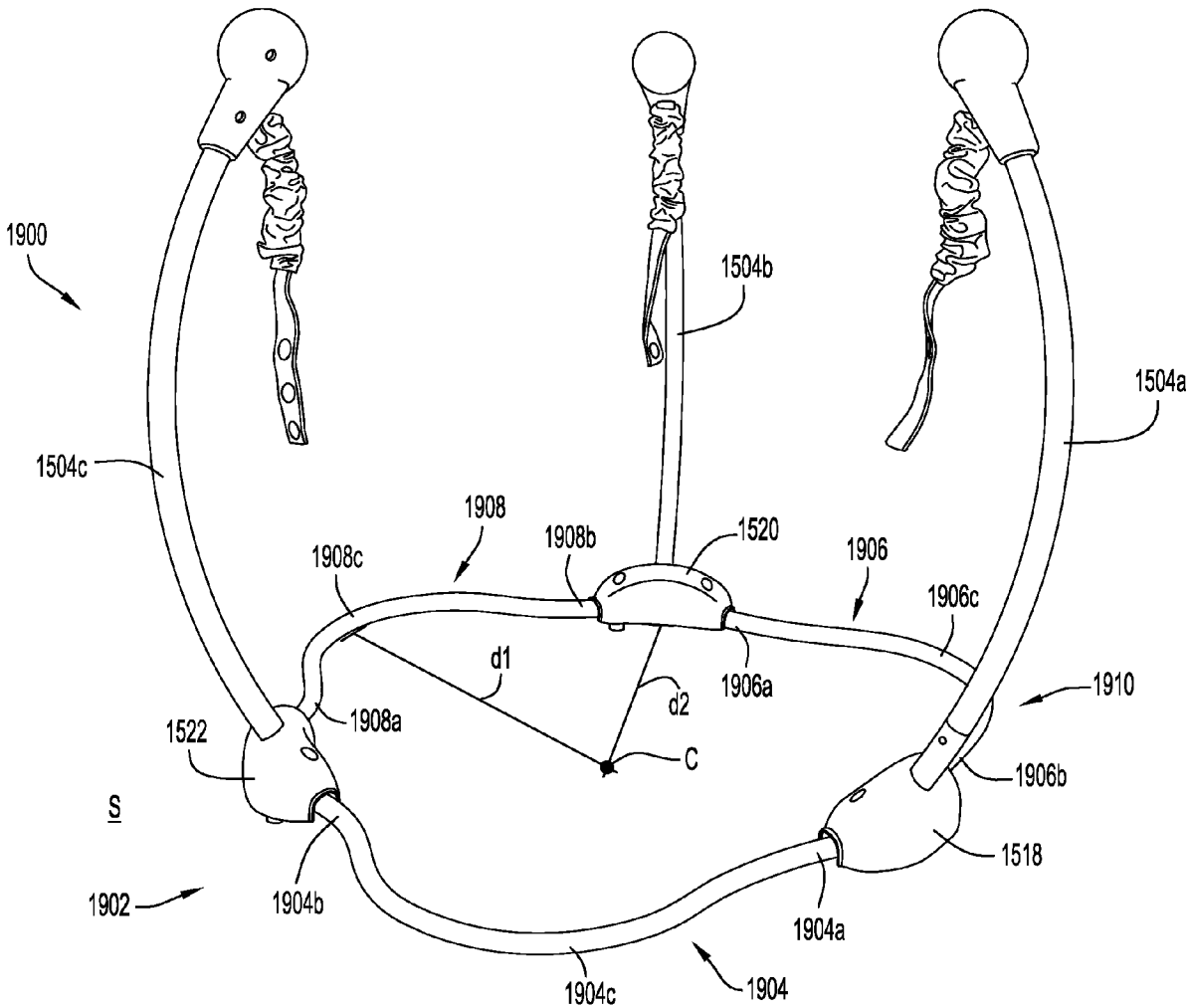
FIG. 23 is a perspective view of an embodiment of a support frame for an infant support structure according to an embodiment of the invention.

Referring to FIG. 23, in another embodiment a support frame 1900, coupleable to the seat portion 1700 via the resilient members 1600 and the toy bar 1800, includes a lower portion 1902 having a generally sinusoidal configuration. In one embodiment, the lower portion 1902 includes a plurality of sections 1904, 1906, 1908 that are coupled together to define a perimeter 1910. Section 1904 includes opposite ends 1904*a* and 1904*b*, and an outwardly curved central portion 1904*c*. Section 1906 includes opposite ends 1906*a* and 1906*b*, and an outwardly curved central portion 1906*c*. Section 1908 includes opposite ends 1908*a* and 1908*b*, and an outwardly curved central portion 1908*c*. In one embodiment, end 1904*a* is coupled to end 1906*b* via connector 1518, end 1906*a* is coupled to end 1908*b* via connector 1520, and end 1908*a* is coupled to end 1904*b* via connector 1522.

The curved portions 1904*c*, 1906*c*, 1908*c* extend outwardly from a center C of the perimeter 1910 of the lower portion 1902 by a distance d1. The connectors 1518, 1520, 1522 are disposed outwardly from the center C of the perimeter 1910 by a distance d2. In one embodiment, distance d1 is greater than distance d2. The sinusoidal configuration of the lower portion 1902 increases the overall footprint of the support frame 1900, as compared to a support frame having a similarly sized lower portion with sections that do not extend outwardly from the center C of the perimeter thereof beyond that of the corresponding connectors (e.g., lower portion 1502 having sections 1512, 1514, 1516 and connectors 1518, 1520, 1522 that all extend outwardly from a center C of the perimeter 1510 substantially the same distance d2). By increasing the footprint of the lower portion 1902, overall stability of the support frame 1900 is further enhanced.

Other than the sinusoidal configuration of the lower section 1902, the support frame 1900 is otherwise identical to support frame 1500. Accordingly, support frame 1900 includes a plurality of posts 1504*a*, 1504*b*, 1504*c* coupled to and extending upwardly from the lower portion 1902.

Referring again to FIG. 22, the seat portion 1700 is disposed between posts 1504*a*, 1504*b*, 1504*c*. The seat portion 1700 is coupled to the upper distal end portions 1508*a*, 1508*b*, 1508*c* via resilient members 1600 so that the seat portion 1700 is movably suspended from the support frame 1500 and relative to the support surface S. The toy bar 1800 includes an end 1802, an opposite end 1804, and a central portion 1806.

Toy elements 1850 are attached to the central portion 1806 of the toy bar 1800, such as by flexible cords or string 1852, so that movement of the toy bar 1800 imparts movement upon the toy elements 1850. In one embodiment, the toy bar 1800 is formed from a flexible plastic material and includes a soft outer shell, such as for example a fabric covering. Alternative or additional toy elements may be coupled to the toy bar 1800. Further, additional entertainment elements may be provided on the seat portion 1700 for entertaining the infant. For example, toy elements 1860 may be coupled to the tray portion 1702 and/or an auxiliary toy bar 1870 may be coupled to the tray portion 1702.

In one embodiment, the seat 1704 is movably coupled to the tray portion 1702, and rotatable 360 degrees relative thereto, such as described above and as shown in FIG. 4B. Thus, the infant can access different portions of the tray portion 1702 and/or any toy elements thereon. The seat 1704 includes a fabric or flexible liner, providing a comfortable surface on which the infant is seated. In one embodiment, the fabric liner is removable, such as for washing.

End 1802 of the toy bar 1800 is coupled to the distal end portion 1508*a* of post 1504*a*. End 1804 of the toy bar 1800 is coupled to the distal end portion 1508*b* of post 1504*b*. Thus, the toy bar 1800 extends between the distal end portions 1508*a*, 1508*b* of posts 1504*a*, 1504*b*, respectively. In one embodiment, the distal end portions 1508*a*, 1508*b* of posts 1504*a*, 1504*b* are located on a plane p1, the seat portion 1700 is located beneath the plane p1, and the toy bar 1800 extends above the plane p1. In other embodiments, the toy bar 1800 does not extend above the plane p1.

End 1802 of the toy bar 1800 is releasably coupleable to the distal end portion 1508*a* of post 1504*a*, and end 1804 is releasably coupleable to the distal end portion 1508*b* of post 1504*b*. In one embodiment, the end 1802 of the toy bar 1800 is coupled to the distal end portion 1508*a* of post 1504*a* via a hub 1538*a*. Similarly, the end 1804 of the toy bar 1800 is coupled to the distal end portion 1508*b* of post 1504*b* via another hub 1538*b*.

Figure 24:
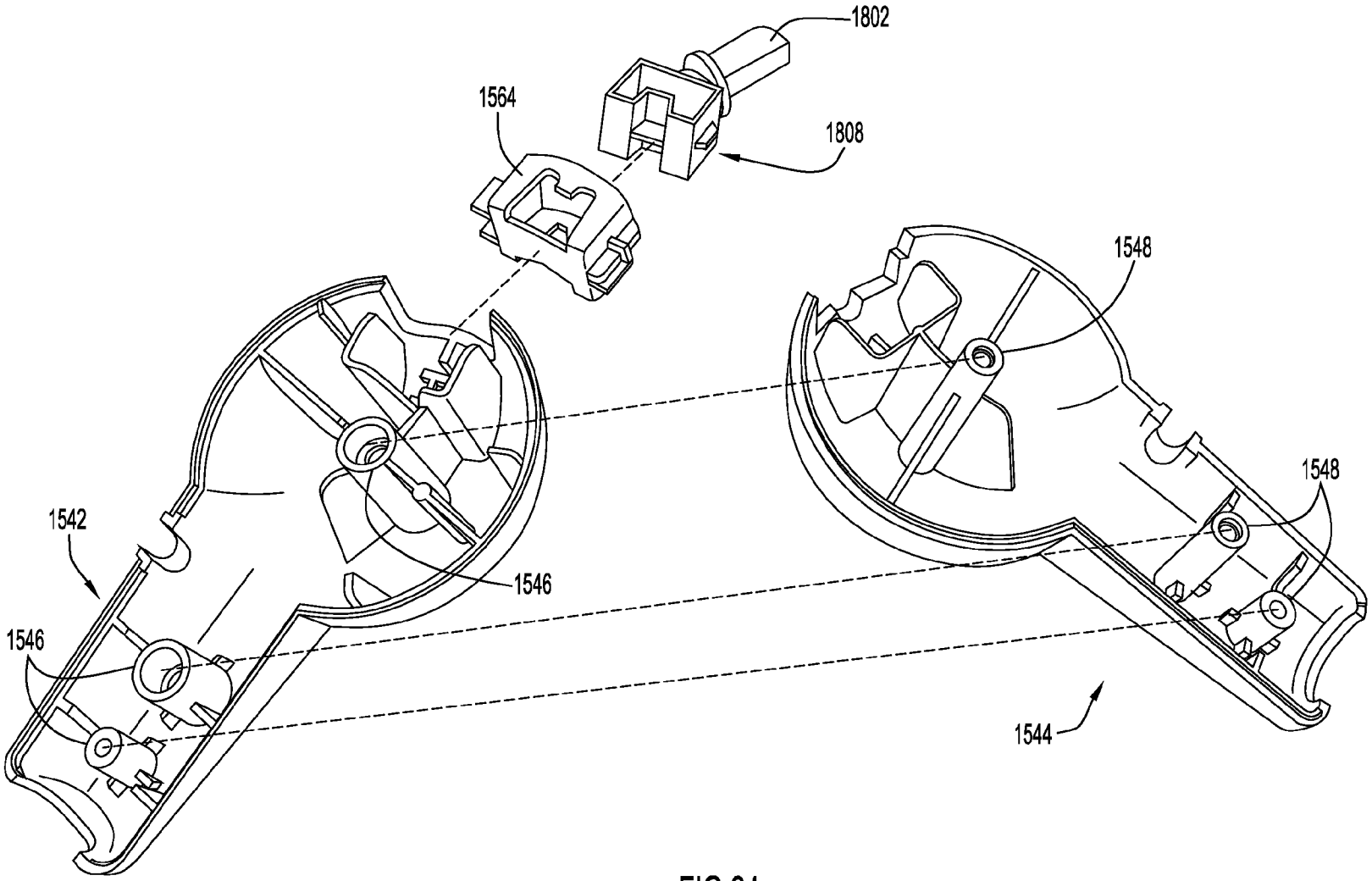
FIG. 24 is a perspective assembly view of a hub of an infant support structure according to an embodiment of the invention.
Figure 25:
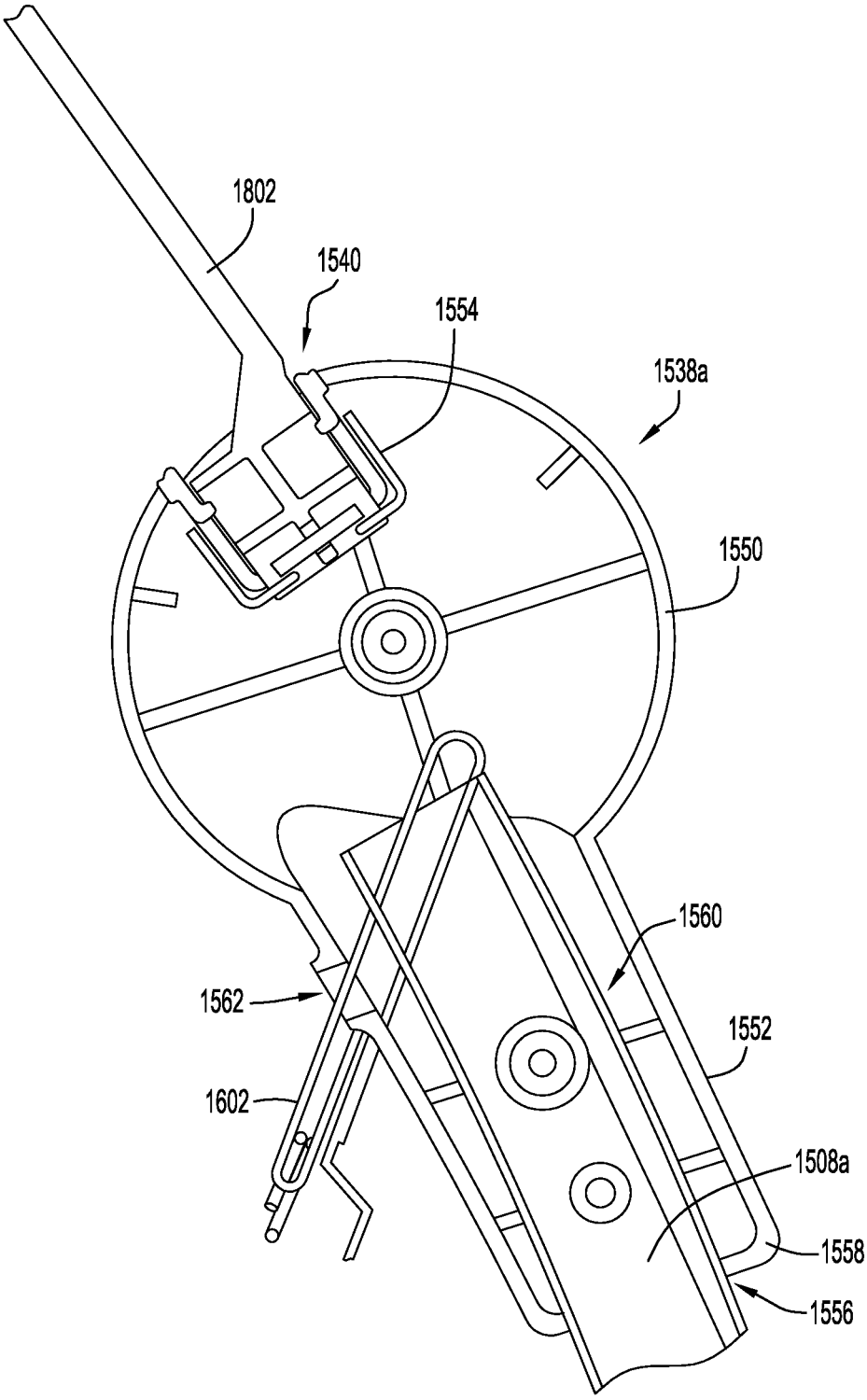
FIG. 25 is a sectional fragmentary view of a hub of an infant support structure according to an embodiment of the invention.

Referring to FIGS. 24 and 25, in one embodiment the hub 1538*a* includes a receiving portion 1540 configured for releasably retaining the end 1802 of the toy bar 1800. The hub 1538*a* may be formed from two half sections 1542, 1544 that are secured together via fasteners (not shown) such as pins, screws, bolts, or the like, which extend through aligned receiving posts 1546, 1548. When the sections 1542, 1544 are secured together, the resulting hub 1538*a* includes a bulbous upper portion 1550 and a stem 1552. The upper portion 1550 of the hub 1538*a* defines an opening or well 1554. The stem 1552 defines an axially aligned opening 1556 in an end 1558 thereof and in communication with a cavity 1560. The stem 1552 also defines a slot 1562 spaced from the opening 1556 and in communication with the cavity 1560.

The distal end portion 1508*a* of post 1504*a* extends through the opening 1556 and into the cavity 1560, and is secured therein via fasteners (not shown). For example, the distal end portion 1508*a* may include openings through which the receiving posts 1546 and/or 1548 extend, and/or through which associated fasteners extend. Thus, the distal end portion 1508*a* is securely retained within the cavity 1560 and fixedly secured to the hub 1538*a*. The end portion 1602 of a corresponding one of the resilient members 1600 extends through the slot 1562 and is also secured within the cavity 1560, such as through or around a portion of the distal end portion 1508*a* of post 1504*a*.

Figure 26:
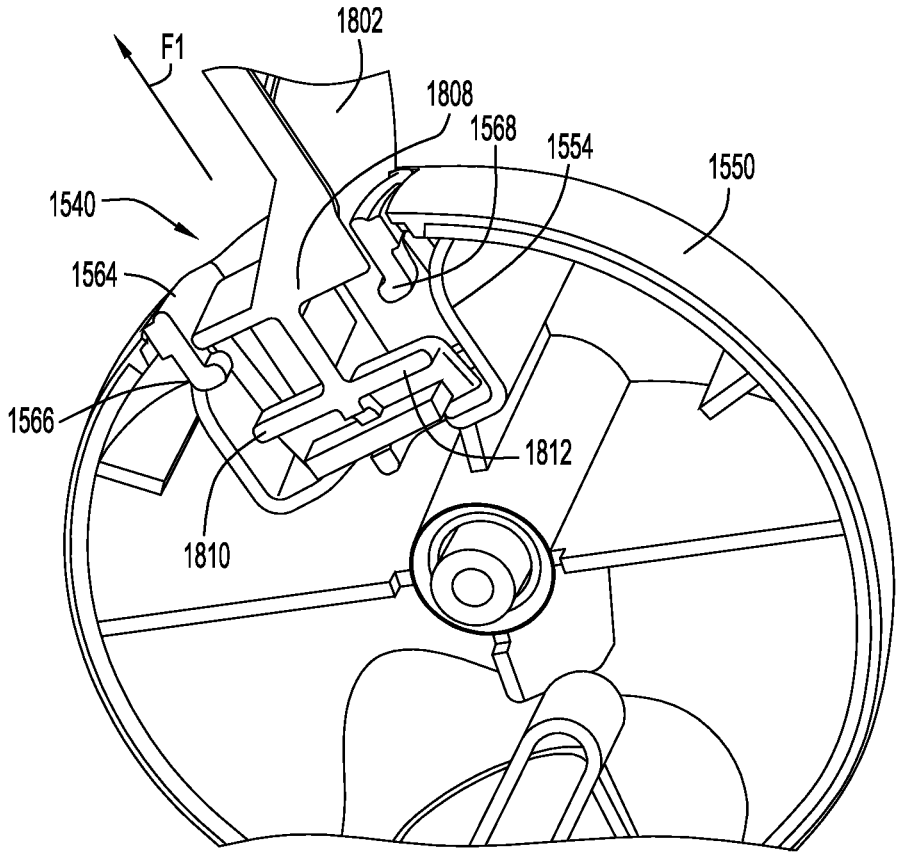
FIG. 26 is a fragmentary sectional perspective view of portions of a hub of an infant support structure according to an embodiment of the invention.

As shown in FIGS. 24 and 26, the receiving portion 1540 includes an engagement member 1564 secured within the well 1554 in the upper portion 1550 of the hub 1538*a*. Any conventional mechanism or system may be employed for securing the engagement member 1564 within the well 1554 (e.g. pins, screws, bolts, latches, adhesive, or the like). Alternatively or in addition, the engagement member 1564 may have dimensions or a footprint greater than the dimensions of the opening of the well 1554, so that the engagement member 1564 is fixedly retained therein when the sections 1542, 1544 of the hub 1538*a* (or hub 1538*b*) are secured together.

In one embodiment, the end 1802 of the toy bar 1800 includes a coupling member 1808 releasably securable within the engagement member 1564. In one embodiment, the engagement member 1564 includes resilient latches 1566, 1568 that engage correspondingly configured arms 1810, 1812 if the end 1802 is lifted upwardly. After the end 1802 of the toy bar 1800 is inserted into the well 1554, the coupling member 1808 remains secured to the engagement member 1564 unless a sufficient amount of upwardly directed force F1 is applied to the end 1802. Upon application of an upward force F1, such as by a parent or care giver, the resilient latches 1566, 1568 are deflected outwardly by the arms 1810, 1812, so that the coupling member 1808 is decoupled from the engagement member 1564. In this way, the end 1802 of the toy bar 1800 may be decoupled from the hub 1538*a*.

The upwardly directed force F1 applied to the end 1802 of the toy bar 1800 permits the parent or caregiver to easily decouple the toy bar 1800 from the hub 1538*a*. However, such force F1 is not easily applied by a smaller child or infant, particularly an infant disposed within the seat 1704, given the seat portion 1700 is disposed beneath the plane p1 of the distal end portion 1508*a*, 1508*b* of posts 1504*a*, 1504*b* and the toy bar 1800 extends above the plane p1 (as shown in FIG. 22). As such, an infant disposed in the seat 1704 must generally reach upwardly to grab the toy bar 1800 and typically pulls downwardly toward the seat portion 1700, which will not result in the proper directional force F1 sufficient to decouple the end 1802 from the hub 1538*a*.

In one embodiment, the hub 1538*b* has a configuration substantially identical to the configuration of the hub 1538*a*. Accordingly, the end 1804 of the toy bar 1800 is releasably retained within a receiving portion 1540. The distal end portion 1508*b* of post 1504*b* extends through the opening 1556 and is secured within the cavity 1560. The end portion 1602 of another corresponding one of the resilient members 1600 extends through the slot 1562 and is also secured within the cavity 1560, as described above.

Figure 27:
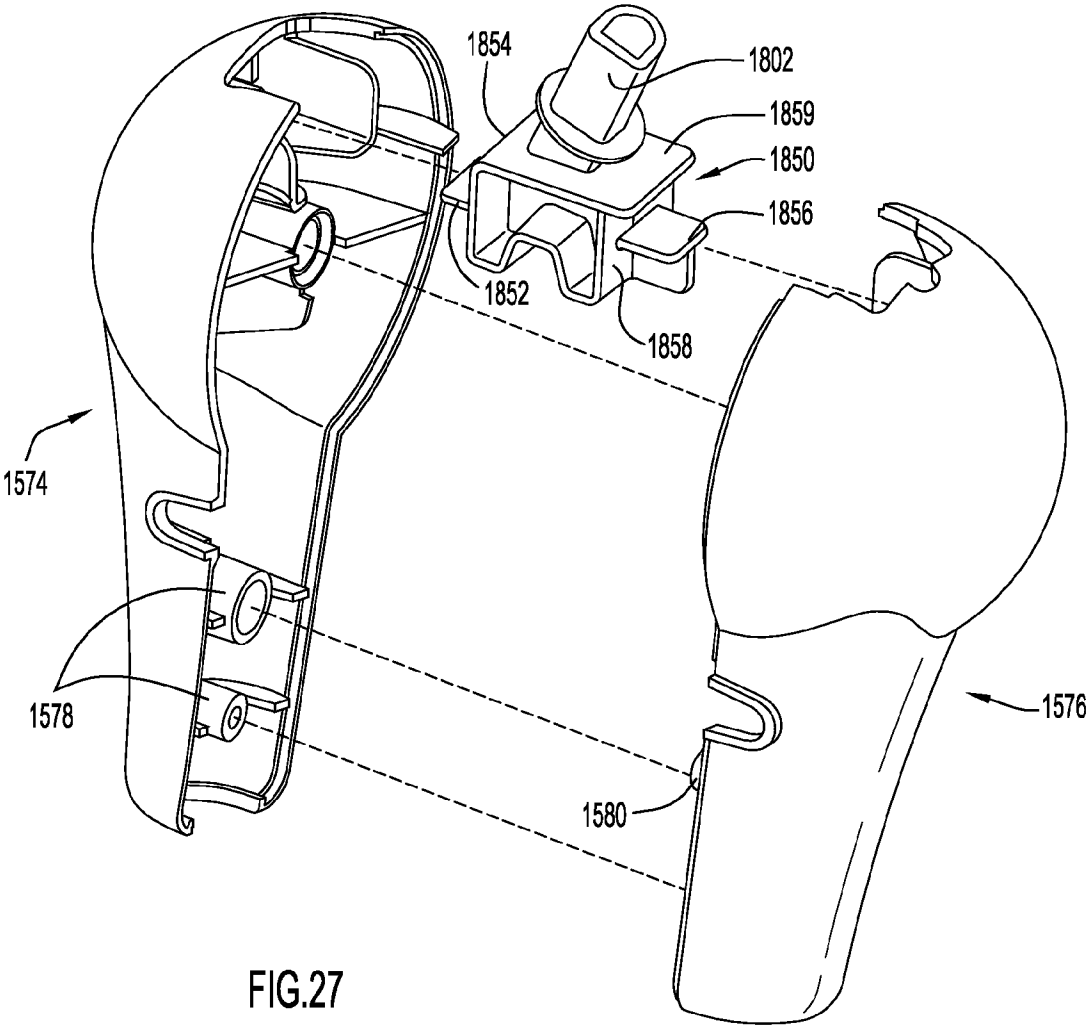
FIG. 27 is a perspective assembly view of a hub of an infant support structure according to an embodiment of the invention.
Figure 28:
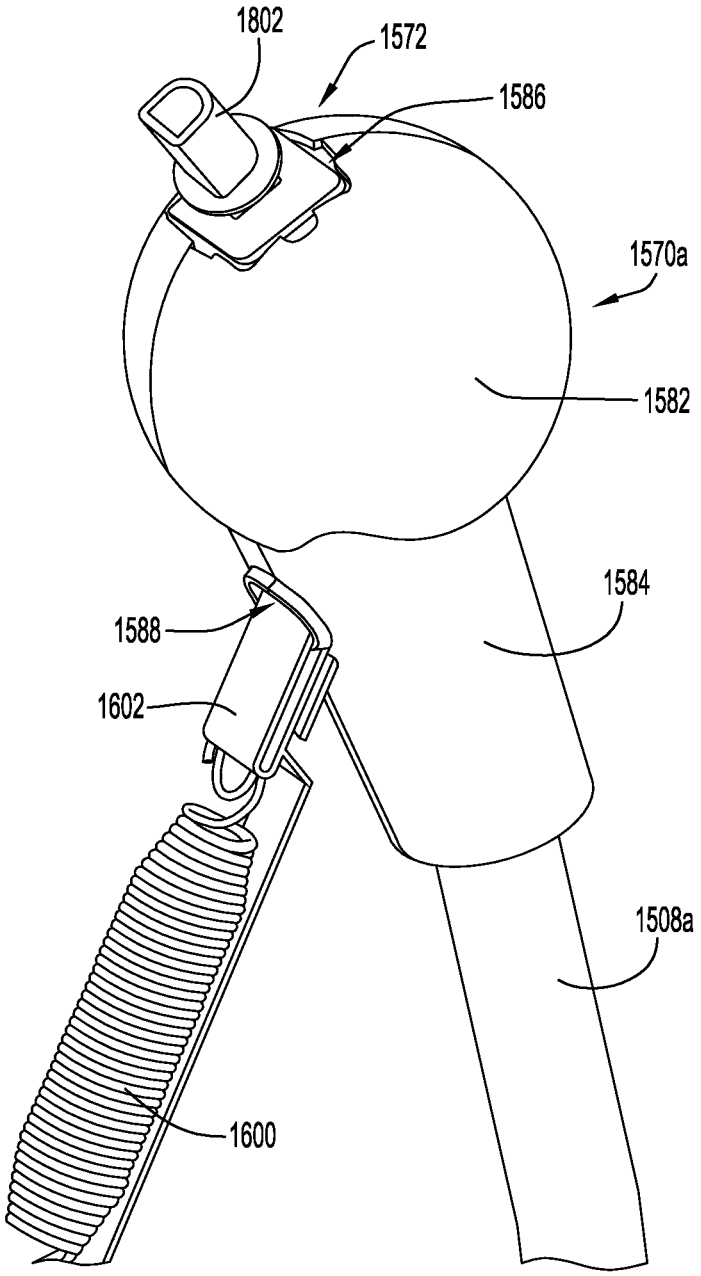
FIG. 28 is a perspective view of the hub of an infant support structure, and showing portions of a post and a resilient member.

In an alternative embodiment, the toy bar 1800 includes opposing ends 1802, 1804 that are fixedly secured to the distal end portions 1508*a*, 1508*b* of posts 1504*a*, 1504*b*, respectively. Referring to FIGS. 27 and 28, in one embodiment the end 1802 of the toy bar 1800 is secured to the distal end portion 1508*a* of post 1504*a* via a hub 1570*a*. Similarly, the end 1804 of the toy bar 1800 is coupled to the distal end portion 1508*b* of post 1504*b* via another hub 1570*b* having a configuration substantially identical to hub 1570*a*.

Each of the hubs 1570*a*, 1570*b* includes some similar features as compared to the hubs 1538*a*, 1538*b*, except for the configuration of a receiving portion 1572. Thus, each of the hubs 1570*a*, 1570*b* are formed from two half sections 1574, 1576 that are secured together via fasteners (not shown) such as pins, screws, bolts, or the like, which extend through aligned receiving posts 1578, 1580. When the sections 1574, 1576 are secured together, the resulting hub 1570*a* (or 1570*b*) includes a bulbous upper portion 1582 and a stem 1584. The upper portion 1582 defines an opening or well 1586. The stem 1584 defines an axially aligned opening and cavity (not shown) in which the distal end portion 1508*a* of post 1504*a* (or distal end portion 1508*b* or post 1504*b*) is secured. The stem 1584 also defines a slot 1588 in communication with the internal cavity of the stem 1584, and through which the end portion 1602 of a corresponding one of the resilient members 1600 extends.

However, the receiving portion 1572 of each of the hubs 1570*a*, 1570*b* is configured to fixedly retain a corresponding one of the ends 1802, 1804 of the toy bar 1800. Referring to FIG. 27, in one embodiment the end 1802 of the toy bar 1800 includes a coupling member 1850 including a flange 1852 extending outwardly from an end wall 1854, and another flange 1856 extending outwardly from an opposite end wall 1858 thereof. Flange 1852 is received in a correspondingly configured slot and/or is disposed beneath a shelf disposed within the well 1586 of the receiving portion 1572. Similarly, flange 1856 is received in a correspondingly configured slot and/or is disposed beneath another shelf disposed within the well 1586. Thus, the coupling member 1850 is fixedly secured within the well 1586 of the hub 1570*a* when the two half sections 1574, 1576 of the hub 1570*a* (or 1570*b*) are secured together.

In one embodiment, flange 1852 has a configuration and flange 1856 has another configuration different than the configuration of flange 1852. The coupling member 1850 is secured within the well 1586 when each of flanges 1852, 1856 are properly aligned with their correspondingly configured slots and/or engagement components within the well 1586. For example, as shown in FIG. 27, flange 1852 may have a generally linear or plate-like configuration while flange 1856 has a T-shaped configuration. In other embodiments, the configuration of flange 1852 is substantially identical to the configuration of flange 1856.

Alternative mechanisms for securing the ends 1802, 1804 to hubs 1570*a*, 1570*b* (and/or to end portions 1508*a*, 1508*b*) may be employed. For example, the coupling member 1850 may include a surface 1859 having a footprint greater than the opening defining the well 1586, so that the coupling member 1850 is trapped within the well 1586 when the sections 1574, 1576 of the hub 1570*a* (or 1570*b*) are secured together. Alternatively or in addition, the ends 1802, 1804 and/or the coupling members 1850 may be secured to the corresponding hubs 1570*a*, 1570*b* via pins, screws, bolts, adhesive, or the like. Thus, any conventional fastening mechanism or system may be employed for fixedly securing the ends 1802, 1804 to the hubs 1570*a*, 1570*b* (and/or to end portions 1508*a*, 1508*b*).

Once the ends 1802, 1804 of the toy bar 1800 are secured to hubs 1570*a*, 1570*b* via coupling members 1850 and receiving portions 1572, the toy bar 1800 is able to withstand a predetermined amount of force before the ends 1802, 1804 break away from the hubs 1570*a*, 1570*b* (e.g. a predetermined amount of force as determined by industry standards).

While various embodiments of the invention have been described above, it should be understood that they have been presented by way of example only, and not limitation. For example, although the jumping devices are shown and described as having multiple resilient members, in some embodiments a jumping device according to the invention can include a single resilient member. In yet other embodiments, a jumping device can include a single resilient member having three or more end portions configured to be coupled to a child support portion and/or a support frame.

Similarly, although the resilient members are shown and described has being thin straps, in some embodiments the resilient members can be of any suitable shape, such as, for example, a member having a round cross-sectional shape.

Although the seat frame is shown and described as being rotatably coupled in one embodiment of the invention, it is understood that a rotatably coupled seat can be included in any embodiments of the invention. Conversely, in some embodiments, the seat frame is fixedly coupled to the tray portion. In other embodiments, the seat does not include a seat frame, but rather only includes the padded material coupled directly to the tray portion by a series of fasteners, such as snaps, buttons and/or hook and loop fasteners. In yet other embodiments, the seat does not include a padded material, but rather only includes a seat frame configured to retain a child. In still other embodiments, the child support member is a monolithically formed structure that includes both a tray portion and a seat.

Although specific embodiments are shown and described as having specific mechanisms for attaching the retainer to the child support member and/or the support frame, any of the disclosed attachment mechanisms can be used in any combination to attach any portion of the retainer to the child support member and/or the support frame.

Therefore, although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A jumper apparatus for a child, the apparatus comprising:

a support frame;

a toy bar coupled to the support frame;

a toy element coupled to the toy bar;

a child seat suspended from the support frame;

a first resilient member comprising a first end portion coupled to the support frame and a second end portion coupled to the child seat; and a second resilient member comprising a first end portion coupled to the support frame and a second end portion coupled to the child seat, wherein the second end portion of at least one of the first resilient member and the second resilient member is selectively repositionable with respect to the child seat to alter the position of the child seat with respect to the support frame.

2. The jumper apparatus of claim 1, wherein the second end portion of each of the first resilient member and the second resilient member is selectively repositionable with respect to the child seat to alter the position of the child seat with respect to the support frame.

3. The jumper apparatus of claim 1, wherein:

the support frame comprises:

a base portion to contact a supporting surface, and an upright portion extending distally from the base portion; and the toy bar is coupled to the upright portion of the support frame.

4. The jumper apparatus of claim 1, wherein:

the support frame comprises:

a first frame member including a base portion to contact a supporting surface and an upright portion;

a second frame member including a base portion to contact the supporting surface and an upright portion; and the toy bar is coupled to the upright portion of each of the first frame member and the second frame member.

5. The jumper apparatus of claim 4, wherein:

the toy bar includes:

an elongated member having a first end and a second end, and the toy element is coupled to the elongated member of the toy bar;

the first end of the elongated member of the toy bar is coupled to the first frame member; and the second end of the elongated member of the toy bar is coupled to the second frame member.

6. The jumper apparatus of claim 1, wherein:

the support frame comprises:

a first frame member having a proximal portion and a distal portion, the first end portion of the first resilient member being coupled to the distal portion of the first frame member, and a second frame member having a proximal portion and a distal portion, the first end portion of the second resilient member being coupled to the distal portion of the second frame member; and the toy bar extends between the distal portions of the first frame member and the second frame member.

7. The jumper apparatus of claim 1, wherein:

the support frame comprises a hub including a hub slot; and one of the plurality of resilient members passes through the hub slot.

8. The jumper apparatus of claim 1, wherein:

the support frame comprises:

a first frame member having a proximal portion and a distal portion, and a second frame member having a proximal portion and a distal portion, the support frame further comprises a hub disposed on the distal portion of the frame member, the hub including a first complementary connection; and the toy bar includes a second complementary connection adapted to mate with the first complementary connection on the hub.

9. The jumper apparatus of claim 1, wherein:

the support frame comprises:

a base portion, a first upright portion, and a second upright portion, a first hub mounted on the first upright portion, the first resilient member extending from the first hub, a second hub mounted on the second upright portion, the second resilient member extending from the second hub;

the toy bar includes a first end portion and second end portion, wherein each end portion of the toy bar includes a toy bar coupling member; and each of the first hub and the second hub includes a cavity to receive one of the toy bar coupling members and thereby releasably secure the toy bar to the support frame.

10. The jumper apparatus of claim 9, wherein:

the first hub includes a first hub slot;

the first resilient member extends through the first hub slot;

the second hub includes a second hub slot; and the second resilient member extends through the second hub slot.

11. A jumper apparatus for a child, the apparatus comprising:

a support frame for supporting the jumper apparatus on a supporting surface, the support frame including a plurality of frame members extending distally from a supporting surface, each of the frame members having a distal end;

a toy bar coupled to the support frame;

a child seat comprising a plurality of openings disposed at predetermined positions about the child seat; and a plurality of resilient members suspending the child seat from the support frame such that the seat is oriented completely below the distal ends of the frame members, wherein one or more of the resilient members extends through an associated opening of the plurality openings of the child seat.

12. The jumper apparatus of claim 11, wherein the position of the child seat relative to the supporting surface is selectively adjustable via repositioning of a resilient member through its associated child seat opening.

13. The jumper apparatus of claim 11, wherein the position of the child seat relative to the supporting surface is selectively adjustable via repositioning of each resilient member through its associated child seat opening.

14. The jumper apparatus of claim 11, wherein:

the plurality of frame members includes a first frame member and a second frame member;

the toy bar includes:

an elongated member having a first end and a second end, and a toy element coupled to the elongated member;

the first end of the elongated member is mounted to the first frame member of the plurality of frame members; and the second end of the elongated member is mounted to the second frame member of the plurality of frame members.

15. The jumper apparatus of claim 11, wherein:

the support frame further comprises a hub coupled to a frame member of the plurality of frame members, the hub being coupled to the frame member distal end;

the hub includes a hub slot; and a resilient member of the plurality of resilient members passes through the hub slot.

16. The jumper apparatus of claim 11, wherein:

the support frame further comprises a hub coupled to a frame member of the plurality of frame members, the hub being coupled to the frame member distal end;

the hub includes a first complementary connection; and the toy bar includes a second complementary connection adapted to mate with the first complementary connection on the hub.

17. The jumper apparatus of claim 11, wherein:

the plurality of resilient members includes a first resilient member and a second resilient member;

the support frame comprises:

a base portion, a first frame member extending upward from the base portion, and a second frame member extending upward from the base portion, a first hub mounted on the first frame member, the first resilient member extending from the first hub, a second hub mounted on the second frame member, the second resilient member extending from the second hub;

the toy bar includes a first end portion and second end portion, wherein each end portion of the toy bar includes a coupling member; and each of the first hub and the second hub includes a cavity to receive one of the coupling members and thereby releasably secure the toy bar to the support frame.

18. The jumper apparatus of claim 17, wherein:

the first hub includes a first hub slot;

the first resilient member extends through the first hub slot;

the second hub includes a second hub slot; and the second resilient member extends through the second hub slot.

19. A jumper apparatus for a child, the apparatus comprising:

a support frame including:

a base configured to engage a support surface, and a plurality of upright supports spaced about the base, wherein the base and the upright supports cooperate to define a seating area;

a toy bar coupled to the support frame;

a child support member positioned within the seating area defined by the base and the upright supports, the child support member including a top surface, a bottom surface, and a plurality of openings disposed about the child support member; and a plurality of resilient members suspending the child support member from the upright supports of the support frame, the resilient members permitting movement of the child support member with respect to the support frame, wherein each of the resilient members extends through one of said plurality of support member openings, wherein the position of the child support member relative to the support surface is selectively adjustable.

20. The jumper apparatus of claim 19, wherein the support frame further comprises a hub disposed on one or more of the upright supports, the hub including a hub connection complementary to a toy bar connection disposed on the toy bar.

21. A jumper apparatus for a child, the apparatus comprising:

a support frame;

a toy bar formed from a flexible material coupled to the support frame;

a child seat suspended from the support frame;

a first resilient member comprising a first end portion coupled to the support frame and a second end portion coupled to the child seat; and a second resilient member comprising a first end portion coupled to the support frame and a second end portion coupled to the child seat, wherein the second end portion of at least one of the first resilient member and the second resilient member is selectively repositionable with respect to the child seat to alter the position of the child seat with respect to the support frame.

22. The jumper apparatus of claim 21, wherein the flexible material is a plastic material.

* * * * *